US009469814B2

(12) United States Patent
Long et al.

(10) Patent No.: US 9,469,814 B2
(45) Date of Patent: Oct. 18, 2016

(54) SODIUM CITRATE AND CAUSTIC AS PROCESS AIDS FOR THE EXTRACTION OF BITUMEN FROM MINED OIL SANDS

(71) Applicant: SYNCRUDE CANADA LTD. in trust for the owners of the Syncrude Project as such owners exist now and, Fort McMurray (CA)

(72) Inventors: Jun Long, Edmonton (CA); Yong Joe Gu, Edmonton (CA)

(73) Assignee: SYNCRUDE CANADA LTD. in trust for the owners of the Syncrude Project as such owners exist now and in the future, Fort McMurray (CA)

( * ) Notice: Subject to any disclaimer, the term of this patent is extended or adjusted under 35 U.S.C. 154(b) by 35 days.

(21) Appl. No.: 14/607,771

(22) Filed: Jan. 28, 2015

(65) Prior Publication Data

US 2015/0210929 A1 Jul. 30, 2015

Related U.S. Application Data

(60) Provisional application No. 61/933,069, filed on Jan. 29, 2014.

(51) Int. Cl.
*C10G 1/04* (2006.01)

(52) U.S. Cl.
CPC ..... *C10G 1/047* (2013.01)

(58) Field of Classification Search
CPC ..... C10F 1/047
USPC ..... 510/109, 418
See application file for complete search history.

(56) References Cited

U.S. PATENT DOCUMENTS 5,169,518 A 12/1992 Klimpel et al.
5,626,743 A 5/1997 Humphreys
5,770,049 A 6/1998 Humphreys
2002/0104799 A1 8/2002 Humphreys
2005/0194292 A1 9/2005 Beetge et al.
2010/0101981 A1* 4/2010 Moffett ..... C04B 28/24 208/391

FOREIGN PATENT DOCUMENTS

CA 1100074 4/1981
CA 1094483 1/1983

OTHER PUBLICATIONS

BCE Engineering Inc., "Oil Sands Technology Review", Oil Sands Research and Information Network, University of Alberta, School of Energy and the Environment, Edmonton, Alberta. OSRIN Report No. TR-1. 136 pp., Jul. 2010 http://www.infomine.com/library/publications/docs/BGCEngineering2010.pdf.

David W. Devenny, "Oil Sands Tailings Treatment Technologies (Part B)", Alberta Innovates—Energy and Environment Solutions, Mar. 2010 http://www.akees.ca/media/6937/oil_sand_tailings_technologies_and_practices_b.pdf.

Guntis Moritis, "Innovations push bitumen mining, economics; cut environmental effects", Oil & Gas Journal Newsletter, Sep. 6, 2010 http://www.ogj.com/articles/print/volume-108/issue-33/drilling-_production/innovations-push-bitumen.html.

* cited by examiner

*Primary Examiner* — Randy Boyer
*Assistant Examiner* — Juan Valencia
(74) *Attorney, Agent, or Firm* — Bennett Jones LLP

(57) ABSTRACT

A process for extracting bitumen from an oil sand ore having a fines content up to about 60% and a bitumen content higher than about 6% is provided, comprising mixing the oil sand ore with heated water to form an oil sand slurry; conditioning the oil sand slurry to form a conditioned oil sand slurry; introducing a dosage of sodium citrate to the process either prior to or during the mixing step, or prior to or during the conditioning step, or both; and introducing the conditioned oil sand slurry into a separation zone to form a bitumen froth and tailings.

10 Claims, 15 Drawing Sheets

| | T, °C | |
|---|---|---|
| | WSEP | HUF |
| Tumbler Slurry | 50 | 45 |
| Pipeline Slurry | 50 | 45 |
| PSV Vessel | 50 | 35 |

WSEP: Warm Slurry Extraction Process
HUF: Heat-up Front Process (Aurora)

SODIUM CITRATE AND CAUSTIC AS PROCESS AIDS FOR THE EXTRACTION OF BITUMEN FROM MINED OIL SANDS

FIELD OF THE INVENTION

The present invention relates generally to a process of extracting bitumen from oil sand ores by adding sodium citrate or a combination of sodium citrate and caustic (sodium hydroxide) to condition the oil sand slurry.

BACKGROUND OF THE INVENTION

Oil sand generally comprises water-wet sand grains held together by a matrix of viscous heavy oil or bitumen. Bitumen is a complex and viscous mixture of large or heavy hydrocarbon molecules. The Athabasca oil sand deposits may be efficiently extracted by surface mining which involves shovel-and-truck operations. The mined oil sand is trucked to crushing stations for size reduction, and fed into slurry preparation units where hot water and caustic (sodium hydroxide) are added to form an oil sand slurry. The oil sand slurry may be further conditioned by transporting it using a hydrotransport pipeline to a primary separation vessel (PSV) where the conditioned slurry is allowed to separate under quiescent conditions for a prescribed retention period into a top layer of bitumen froth, a middle layer of middlings (i.e., warm water, fines, residual bitumen), and a bottom layer of coarse tailings (i.e., warm water, coarse solids, residual bitumen). The bitumen froth, middlings and tailings are separately withdrawn. The bitumen froth is de-aerated, heated, and treated to produce diluted bitumen which is further processed to produce synthetic crude oil and other valuable commodities.

"Fines" are particles such as fine quartz and other heavy minerals, colloidal clay or silt generally having any dimension less than about 44 μm. "Coarse solids" are solids generally having any dimension greater than about 44 μm. Oil sand extraction typically involves processing ores which are relatively high in bitumen content and low in fines content. However, there exists an abundance of "poor ores", also referred to as "poor processing ores", which alone yield poor bitumen recovery and consequently cannot be processed unless a high proportion of high-grade, good ores are blended into these dry ore feeds. "Poor ores" are oil sand ores generally having low bitumen content (about 6 to about 10%) and/or high fines content (greater than about 30%). In comparison, "good ores" or "good processing ores" are oil sand ores generally having high bitumen content (about 10 to about 12% or higher) and/or low fines content (less than about 20%).

Caustic is used in bitumen extraction to improve bitumen recovery and froth quality. Caustic promotes the release of natural surfactants from bitumen to the aqueous phase, precipitates divalent cations such as calcium and magnesium, modifies the electrical surface potential of bitumen and solids, adjusts the pH, and makes solids more hydrophilic, leading to better bitumen-solids separation. For an oil sand ore, there is normally an optimal caustic dosage at which the highest bitumen recovery can be obtained and the optimal dosage appears to be determined by both the fines content (Sanford, E., 1983, Can. J. Chem. Eng. 61:554-567) and the ore grade.

However, the use of caustic creates undesired consequences. Caustic is toxic and corrosive, impacting health and the environment and causing scaling on equipment due to precipitation of divalent cations when it is added to the slurry water for slurry preparation. Compared to the caustic dosage for good ores, a higher caustic dosage is required for poor ores, but does not necessarily improve bitumen recovery and froth quality. Poor ore feed often results in high PSV middlings' density and viscosity, leading to low recovery and poor bitumen froth quality. The current solution is to reduce the feed rate and to add more water at the price of lowering production. However, for some poor ores, the use of caustic alone does not provide sufficient improvement in processability. Caustic disperses fines, hindering fines settling and tailings treatment. Higher caustic dosages induce bitumen emulsification which impairs froth treatment.

Due to these problems, it is desirable to replace caustic with an alternative chemical, or to reduce the amount of caustic used in the extraction process. A great number of chemicals have been tested as an alternative for caustic, but were not as effective and economic as caustic.

Accordingly, there is a need for a method of minimizing the amount of caustic used in bitumen extraction while improving overall extraction performance, especially for poor processing ores.

SUMMARY OF THE INVENTION

The current application is directed to a process of extracting bitumen from mined oil sand ores by adding sodium citrate or a combination of sodium citrate and caustic to condition the oil sand slurry. It was surprisingly discovered that by conducting the process of the present invention, one or more of the following benefits may be realized:

(1) The use of comparable dosages of sodium citrate to sodium hydroxide that is currently used by the applicant generally resulted in higher overall bitumen recovery (%), in particular, when poor ore was used.

(2) The combined use of sodium citrate and caustic has a synergistic effect, improving bitumen recovery and froth quality in poor (low-grade high-fines) and good ores.

(3) For good ores, the combined use of sodium citrate and caustic does not have any negative impact on processability.

(4) The combined use of sodium citrate and caustic requires a lower amount of total chemical addition than the use of caustic alone, and was more effective at much lower dosages than caustic alone.

(5) The combined use of sodium citrate and caustic minimizes the amount of caustic, negating problems normally encountered by use of high caustic dosages. Sodium citrate is non-toxic to humans, animals, and the environment; a buffering agent or acidity regulator which can resist changes in pH; and a chelating agent which binds strongly to metal cations.

Thus, in one aspect, use of the present invention may conserve the amounts of process aids used in bitumen extraction and improve bitumen recovery and froth quality.

In one aspect, a process for extracting bitumen from an oil sand ore having a fines content up to about 60% and a bitumen content higher than about 6% is provided, comprising:

- mixing the oil sand ore with water to form an oil sand slurry;
- conditioning the oil sand slurry to form a conditioned oil sand slurry;
- introducing a dosage of sodium citrate to the process either prior to or during the mixing step, or prior to or during the conditioning step, or both; and
- introducing the conditioned oil sand slurry into a separation zone to form a bitumen froth and tailings.

In one embodiment, the dosage of sodium citrate ranges from about 0.001 to about 0.1 wt % of the oil sand ore. In another embodiment, the dosage of sodium citrate ranges from about 0.01 to about 0.05 wt % of oil sand ore.

In one embodiment, the process further comprises adding a dosage of caustic (e.g., sodium hydroxide) to the process either prior to or during the mixing step or prior to or during the conditioning step or both.

In one embodiment, the dosage of caustic ranges from about 0.001 to about 0.1 wt % of the oil sand ore. In another embodiment, the dosage of caustic ranges from about 0.01 to about 0.05 wt % of oil sand ore.

In one embodiment, when the bitumen content of the oil sand ore ranges from about 6% to about 10% and the fines content of the oil sand ore is greater than about 25%, the caustic dosage ranges from about 0.01 wt % to about 0.05 wt % and the sodium citrate dosage ranges from about 0.003 wt % to about 0.05 wt %.

In another aspect, a process of extracting bitumen from oil sand ores having a fines content up to about 60% and a bitumen content higher than about 6% is provided, comprising:

- determining a dosage (wt %) of caustic necessary to maximize the bitumen recovery from the oil sand ore to be processed when using caustic alone as a processing aid;
- determining an amount of caustic (wt %) and an amount of sodium citrate (wt %) which yields substantially the same bitumen recovery or greater as the dosage of caustic (wt %) alone;
- mixing the oil sand ore with heated water to produce an oil sand slurry; and
- adding the amounts of caustic (wt %) and sodium citrate (wt %) before, during or after mixing the oil sand ore with heated water to condition the oil sand slurry and to improve bitumen recovery from the oil sand ore;
- wherein the sum of the amounts of caustic (wt %) and sodium citrate (wt %) is either equal to or less than the dosage (wt %) of caustic alone.

In one embodiment, the amount of caustic ranges from about 0.01 wt % to about 0.05 wt % of oil sand ore. In one embodiment, the amount of sodium citrate ranges from about 0.003 wt % to about 0.05 wt % of oil sand ore. In one embodiment, the oil sand ore is poor processing ore having a bitumen content of about 6 to about 10% or a fines content greater than about 30% or both.

In one embodiment, the amount of caustic is about 0.01 wt % of good processing ore. In one embodiment, the amount of sodium citrate ranges from about 0.003 wt % to about 0.03 wt % of good processing ore.

In one embodiment, when the bitumen content of the oil sand ore ranges from about 6% to about 10% and the fines content of the oil sand ore is greater than about 25%, the caustic amount ranges from about 0.01 wt % to about 0.05 wt %, and the sodium citrate amount ranges from about 0.003 wt % to about 0.05 wt %.

In one embodiment, the caustic is sodium hydroxide.

In one embodiment, the sodium citrate is trisodium citrate.

DESCRIPTION OF THE DRAWINGS

Referring to the drawings wherein like reference numerals indicate similar parts throughout the several views, several aspects of the present invention are illustrated by way of example, and not by way of limitation, in detail in the figures, wherein.

DESCRIPTION OF THE PREFERRED EMBODIMENT

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The present invention relates generally to a process of extracting bitumen from mined oil sand ores by adding a combination of sodium citrate and caustic to condition the oil sand slurry.

In one embodiment of the process of the present invention useful in extracting bitumen from oil sand ores, oil sand is mined from an oil sand rich area such as the Athabasca Region of Alberta. The oil sand ore may comprise a fines content up to about 60% and a bitumen content greater than about 6%.

Figure 1:
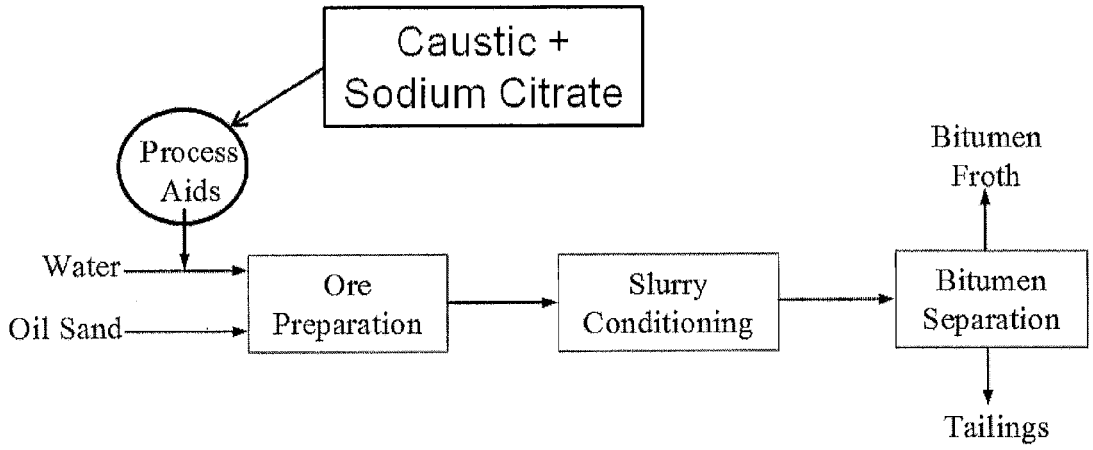
FIG. 1 is a schematic showing, in general, the extraction process for extracting bitumen from mined oil sand ore.

FIG. 1 is a general schematic of a bitumen extraction process from mined oil sand ore. The oil sand is mixed with heated water in a slurry preparation unit. The slurry preparation unit may comprise a tumbler, screening device and pump box; however, it is understood that any slurry preparation unit known in the art can be used.

In addition to the oil sand and water, sodium citrate and caustic are also added to the slurry preparation unit to aid in conditioning the oil sand slurry. As used herein, the term "sodium citrate" means any sodium salt of citric acid including monosodium citrate, disodium citrate, and trisodium citrate. Synonyms, abbreviations, and other names for sodium citrate include citrosodine, citric acid trisodium salt dehydrate, 2-hydroxy-1,2,3-propanetricarboxylic acid trisodium salt, citnatin, citrosodine, citrine, and natrocitral. In one embodiment, sodium citrate comprises trisodium citrate having the molecular formula $Na_3C_6H_5O_7$.

In one embodiment, the process aids are added to the heated water. In another embodiment, the process aids are added directly to the slurry preparation unit. In another embodiment, the process aids are added prior to the conditioning step.

In one embodiment, the process aids comprises sodium citrate. The dosage of sodium citrate generally ranges from about 0.001 to about 0.1 wt %, depending upon the grade of oil sand ore (i.e., poor processing oil sand ore versus good processing oil sand ore). In one embodiment, the dosage of sodium citrate ranges from about 0.01 to about 0.05 wt %.

In one embodiment, the process aids comprises a combination of sodium citrate and caustic. The amount of caustic is determined by initially testing varying caustic dosages to elucidate the optimal caustic dosage which yields a desired primary bitumen recovery. In one embodiment, the amount of caustic ranges from about 0.01 wt % to about 0.05 wt % of poor oil sand ore. In one embodiment, the amount of caustic is about 0.01 wt % of good oil sand ore. In one embodiment, the caustic is sodium hydroxide.

The amount of sodium citrate is generally determined by the optimal caustic dosage and type/grade of oil sand ore. In one embodiment, the dosage for each of caustic and sodium citrate does not exceed 0.05 wt % since higher dosages are impractical in industrial operations due to costs and efforts to conserve process aids. In one embodiment, the amount of sodium citrate ranges from about 0.003 wt % to about 0.05 wt % of poor oil sand ore. In one embodiment, the amount of sodium citrate ranges from about 0.003 wt % to about 0.03 wt % of good oil sand ore.

The sodium citrate and caustic may be added to the water prior to mixing with oil sand, directly into the slurry preparation unit during mixing, or to the oil sand slurry prepared prior to hydrotransport/slurry conditioning. Preferably, the sodium citrate and caustic are added to the water.

Following the addition of sodium citrate and caustic, the oil sand slurry may be screened through a screen portion, where additional water may be added to clean the rejects (e.g., oversized rocks) prior to delivering the rejects to a rejects pile. The screened oil sand slurry is collected in a vessel such as pump box where the oil sand slurry is then pumped through a hydrotransport pipeline (slurry conditioning), which pipeline is of a adequate length to ensure sufficient conditioning of the oil sand slurry, e.g., thorough digestion/ablation/dispersion of the larger oil sand lumps, coalescence of released bitumen flecks and aeration of the coalesced bitumen droplets.

The conditioned oil sand slurry is then fed to a bitumen separation vessel (also referred to as a primary separation vessel or PSV), which operates under somewhat quiescent conditions to allow the bitumen droplets to rise to the top of the vessel and form bitumen froth. The froth over flows to the launder and is collected for further froth treatment. Tailings are either discarded or further treated for additional bitumen recovery.

Exemplary embodiments of the present invention are described in the following Examples, which are set forth to aid in the understanding of the invention, and should not be construed to limit in any way the scope of the invention as defined in the claims which follow thereafter.

EXAMPLE 1

Samples of three poor ores and one good ore were tested (Table 1). The three poor ores had bitumen contents ranging from 8.7% to 9.6%, with fines contents from 26% up to 39%. The good ore had a bitumen content of 11.9% and a fines content of 16%.

TABLE 1

| Classification of Ore | Poor Ore | | | Good Ore |
|---|---|---|---|---|
| Designation | AR | AAX | AD | AR12 |
| Bitumen, % | 9.0 | 8.7 | 9.6 | 11.9 |
| Solids <44 μm, % | 26 | 39 | 38 | 16 |
| Solids $d_{50}$, μm | 213 | 92 | 80 | 130 |

Batch extraction unit testing was conducted, using blended process water, conducting conditioning at 50° C., and testing different dosages of caustic alone, and a combination of sodium citrate and caustic to assess whether a combination of process aids might have a synergistic effect. The dosages were based upon the dry oil sand weight (500 g for each test). Initial tests involving addition of caustic alone were conducted to find an optimal caustic dosage for each ore, followed by subsequent tests involving addition of sodium citrate and caustic in combination. The dosages for sodium citrate or caustic did not exceed 0.05 wt % since higher dosages are impractical in industrial operations due to costs and efforts to conserve process aids.

Figure 2:
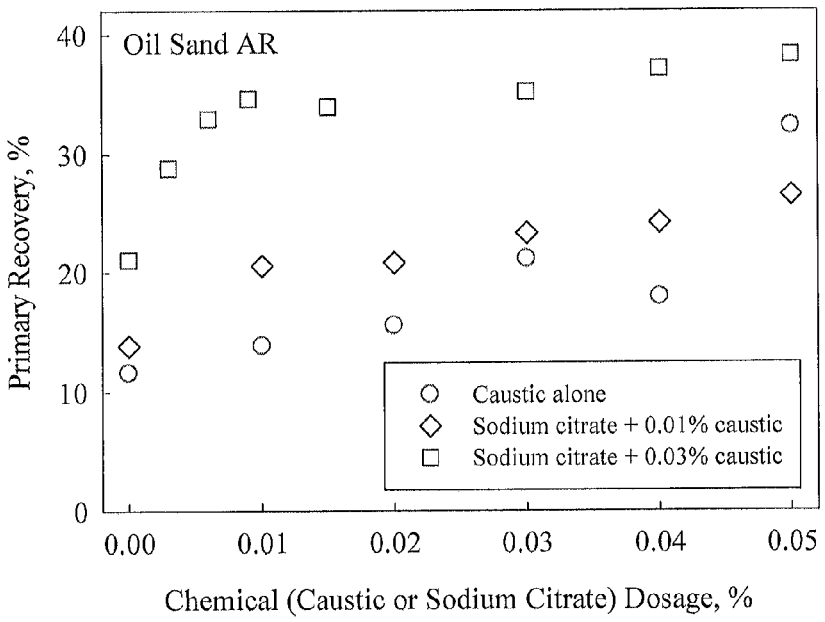
FIG. 2 is a graph showing primary bitumen recovery (%) as a function of dosage (wt %) using caustic alone or in combination with sodium citrate for poor oil sand AR.
Figure 3:
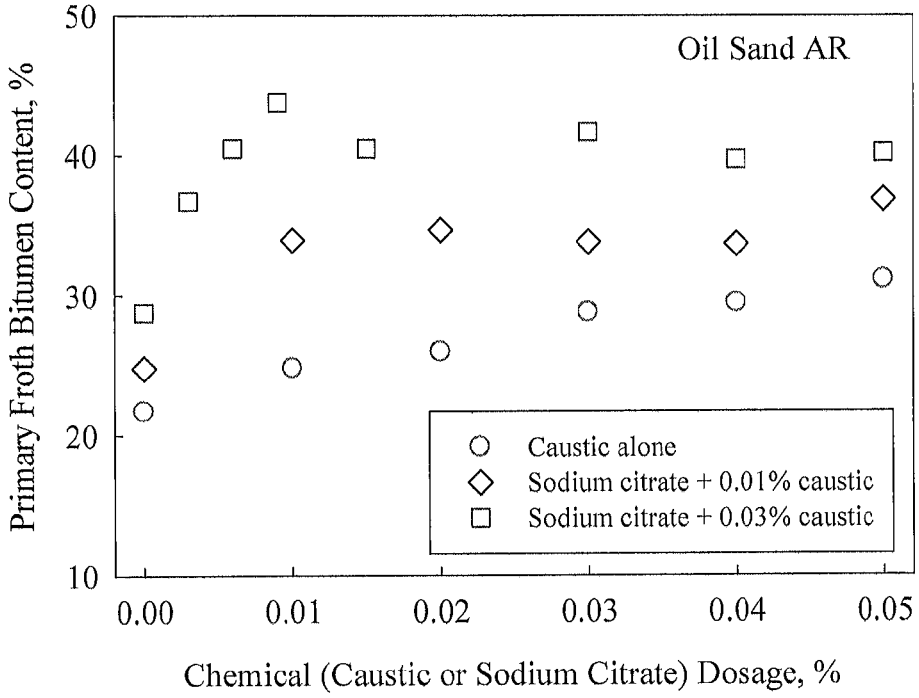
FIG. 3 is a graph showing primary froth bitumen content (%) as a function of dosage (wt %) using caustic alone or in combination with sodium citrate for poor oil sand AR.
Figure 4:
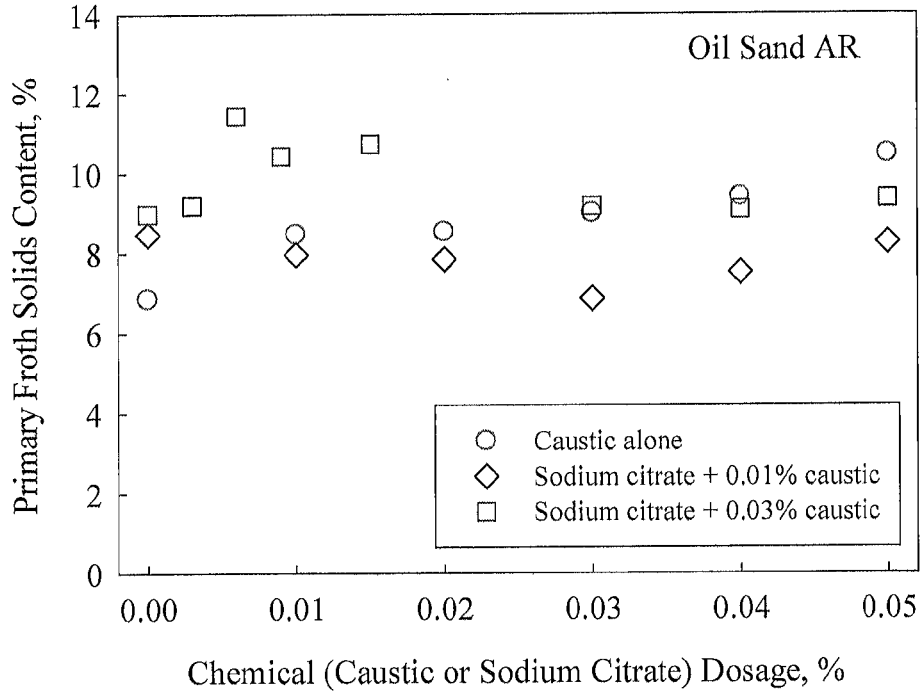
FIG. 4 is a graph showing primary froth solids content (%) as a function of dosage (wt %) using caustic alone or in combination with sodium citrate for poor oil sand AR.

The data were reconciled for material balance using the Bilmat™ program, Version 9.2, 2006 (Algosys Inc., Quebec, CA). The extraction performance was indicated by the primary, secondary, and wall bitumen recoveries ($R_p$, $R_s$, $R_w$), which were calculated using equation (1):

dosage was increased from 0.03 to 0.04 wt %, 0.03 wt % was selected as the dosage for further testing with sodium citrate addition. When the caustic dosage was further increased to 0.05 wt %, the primary bitumen recovery increased to 32.2%. The primary bitumen recovery and primary froth bitumen content generally increased with increasing chemical dosage (FIGS. 2 and 3). The combined use of sodium citrate and caustic improved both primary bitumen recovery and primary froth bitumen content compared to the use of caustic alone. The best performance was achieved with the combination of reagents (caustic at 0.03 wt % and sodium citrate at 0.05 wt %) which yielded a primary bitumen recovery of 38.2% and a primary froth bitumen content of 40.2%. When caustic (0.03 wt %) was combined with different dosages of sodium citrate (0.003-0.05 wt %), the froth solids contents were similar to those obtained with the use of caustic alone (FIG. 4).

TABLE 2

| | Chemical Dosage, wt % | | Bitumen Recovery, % | | | | | Froth Quality | | | | | |
|---|---|---|---|---|---|---|---|---|---|---|---|---|---|
| | | | | | | | | Bitumen Content, % | | | Solids Content, % | | |
| Group | Caustic | Sodium Citrate | Primary | Secondary | Wall Froth | Wall Combined | Total | Primary | Secondary | Combined | Primary | Secondary | Combined |
| 1 | 0 | 0 | 11.6 | 10.4 | 1.1 | 21.9 | 23.0 | 21.7 | 15.7 | 18.4 | 6.9 | 30.1 | 19.7 |
| | 0.01 | 0 | 13.8 | 15.0 | 2.2 | 28.8 | 31.0 | 24.8 | 18.6 | 21.2 | 8.5 | 32.6 | 23.0 |
| | 0.02 | 0 | 15.5 | 14.8 | 2.0 | 30.3 | 32.3 | 25.9 | 17.6 | 21.2 | 8.5 | 31.4 | 22.1 |
| | 0.03 | 0 | 21.1 | 17.7 | 2.1 | 38.8 | 40.9 | 28.8 | 19.8 | 23.8 | 9.0 | 29.5 | 20.4 |
| | 0.04 | 0 | 17.9 | 17.1 | 2.6 | 35.0 | 37.6 | 29.4 | 23.0 | 25.9 | 9.4 | 33.0 | 22.3 |
| | 0.05 | 0 | 32.2 | 18.6 | 3.1 | 50.8 | 53.9 | 31.1 | 22.9 | 27.5 | 10.4 | 28.9 | 18.5 |
| 2 | 0.01 | 0.01 | 20.5 | 13.7 | 0.7 | 34.3 | 34.9 | 33.9 | 18.7 | 25.6 | 8.0 | 33.3 | 21.8 |
| | 0.01 | 0.02 | 20.8 | 14.6 | 0.8 | 35.4 | 36.1 | 34.6 | 17.8 | 24.9 | 7.8 | 29.3 | 20.3 |
| | 0.01 | 0.03 | 23.3 | 14.1 | 0.9 | 37.4 | 38.3 | 33.8 | 18.7 | 25.9 | 6.9 | 32.4 | 20.2 |
| | 0.01 | 0.04 | 24.1 | 16.7 | 0.9 | 40.8 | 41.7 | 33.7 | 18.4 | 25.1 | 7.5 | 33.7 | 22.1 |
| | 0.01 | 0.05 | 26.4 | 18.5 | 1.0 | 44.9 | 45.9 | 36.8 | 20.1 | 27.4 | 8.3 | 32.7 | 22.0 |
| 3 | 0.03 | 0.003 | 28.8 | 23.6 | 1.5 | 52.5 | 54.0 | 36.7 | 22.9 | 28.9 | 9.2 | 33.3 | 22.9 |
| | 0.03 | 0.006 | 32.9 | 23.6 | 2.3 | 56.5 | 58.8 | 40.5 | 24.5 | 31.8 | 11.4 | 33.4 | 23.3 |
| | 0.03 | 0.009 | 34.6 | 24.1 | 2.1 | 58.7 | 60.8 | 43.8 | 23.2 | 32.1 | 10.4 | 31.1 | 22.2 |
| | 0.03 | 0.015 | 33.9 | 23.2 | 1.9 | 57.1 | 59.0 | 40.5 | 21.1 | 29.5 | 10.7 | 30.8 | 22.1 |
| | 0.03 | 0.030 | 35.2 | 29.7 | 1.8 | 64.9 | 66.7 | 41.7 | 26.5 | 33.0 | 9.2 | 32.9 | 22.7 |
| | 0.03 | 0.040 | 37.1 | 24.9 | 1.2 | 62.0 | 63.2 | 39.7 | 23.9 | 31.4 | 9.1 | 31.1 | 20.7 |
| | 0.03 | 0.050 | 38.2 | 26.1 | 1.2 | 64.4 | 65.6 | 40.2 | 26.4 | 33.2 | 9.3 | 34.2 | 22.0 |

$$R_i = \frac{M_{if} \cdot X_{B,if}}{M_{os} \cdot X_{B,os}} \quad (1)$$

where R denotes bitumen recovery; M is the mass; X is the mass fraction; the subscript i represents either primary (p), secondary (s), or wall (w); and the subscripts f, B, and os stand for froth, bitumen, and oil sand, respectively.

The combined recovery ($R_c$) which is the sum of the primary and secondary recoveries was calculated using equation (2):

$$R_c = R_p + R_s \quad (2)$$

The total recovery ($R_t$) which is the sum of the primary, secondary, and wall bitumen recoveries was calculated using equation (3):

$$R_t = R_p + R_s + R_w \quad (3)$$

Poor Ore AR

For poor ore AR, the primary bitumen recovery was 11.6% when no process aid was used (Table 2). The addition of caustic improved processability. As the primary bitumen recovery did not substantially change when the caustic For a fair comparison, the total chemical dosage (caustic and sodium citrate dosages) should be considered. The results of primary bitumen recovery and primary froth bitumen content grouped by the total chemical dosages for oil sand AR are summarized in Table 3. When sodium citrate (0.009 wt %) and caustic (0.03 wt %) were combined, the total chemical dosage was about 0.04 wt %. Compared to caustic alone (0.04 wt %), the primary bitumen recovery increased from 17.9% to 34.6% and primary froth bitumen content increased from 29.4% to 43.8% (Table 3). Even the lowest dosage of sodium citrate (0.003 wt %) in combination with caustic (0.03 wt %) improved the primary bitumen recovery and froth bitumen content compared to caustic alone.

For every group at the same/similar total chemical dosage, the combined use of sodium citrate and caustic improved both the primary bitumen recovery and primary froth bitumen content. However, it is preferred that the sodium citrate dosage be less than about 0.02 wt %.

TABLE 3

| Group | Chemical Dosage, wt % Total | Caustic | Sodium Citrate | Primary Bitumen Recovery, % | Primary Froth Bitumen Content, % |
|---|---|---|---|---|---|
| 1 | 0.020 | 0.02 | 0 | 15.5 | 25.9 |
| | 0.020 | 0.01 | 0.010 | 20.5 | 33.9 |
| 2 | 0.030 | 0.03 | 0 | 21.1 | 28.8 |
| | 0.033 | 0.03 | 0.003 | 28.8 | 36.7 |
| | 0.030 | 0.01 | 0.020 | 20.8 | 34.6 |
| 3 | 0.040 | 0.04 | 0 | 17.9 | 29.4 |
| | 0.036 | 0.03 | 0.006 | 32.9 | 40.5 |
| | 0.039 | 0.03 | 0.009 | 34.6 | 43.8 |
| 4 | 0.050 | 0.05 | 0 | 32.2 | 31.1 |
| | 0.045 | 0.03 | 0.015 | 33.9 | 40.5 |

Figure 5:
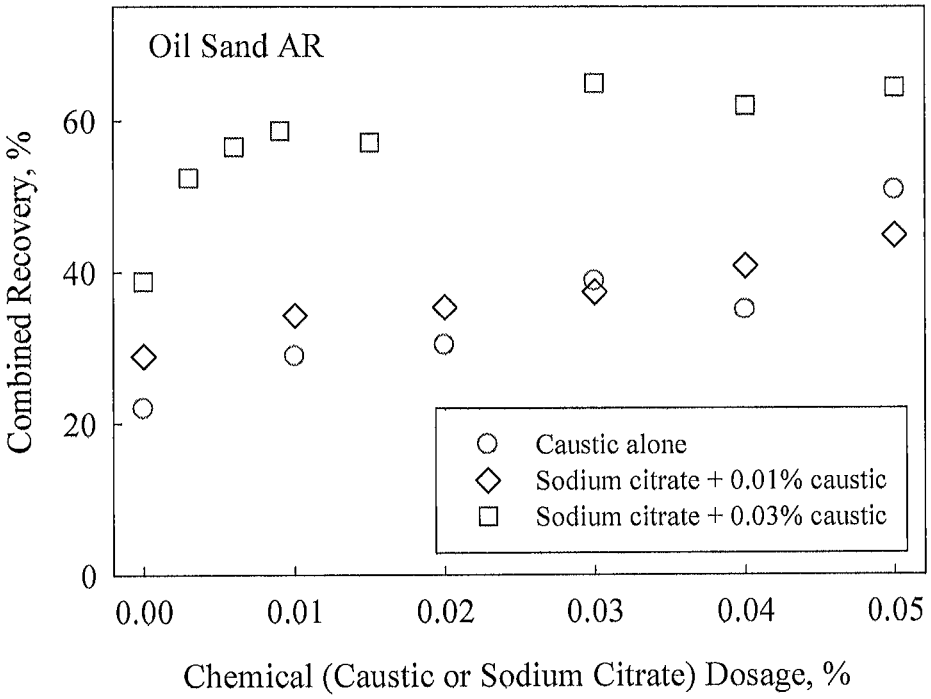
FIG. 5 is a graph showing combined bitumen recovery (%) as a function of dosage (wt %) using caustic alone or in combination with sodium citrate for poor oil sand AR.

Similar to the primary bitumen recovery (FIG. 2), the combined bitumen recovery (sum of the primary plus secondary recoveries; FIG. 5) was also improved by the combination of caustic (0.03 wt %) and sodium citrate at various dosages (0.003-0.05 wt %).

Poor Ore AD

Poor ore AD processed reasonably well with a primary recovery of 70.2% and a total recovery of 87.7% when no process aid was used (Table 4). The addition of caustic improved processability. The caustic dosage of 0.03 wt % was selected based on the results obtained from test series #1.

Figure 9:
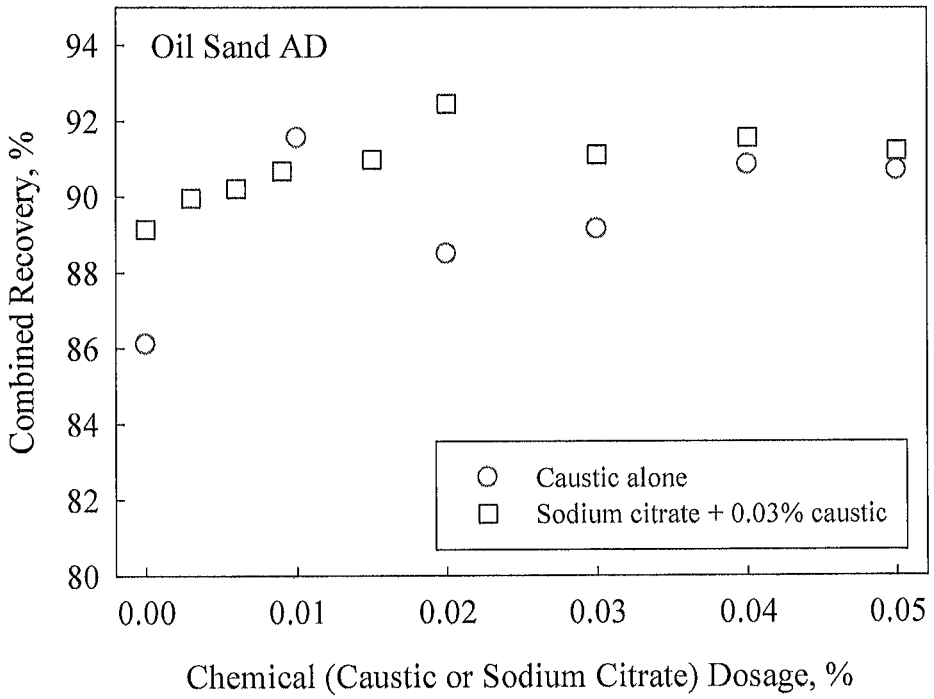
FIG. 9 is a graph showing combined bitumen recovery (%) as a function of dosage (wt %) using caustic alone or in combination with sodium citrate for poor oil sand AD.
Figure 10:
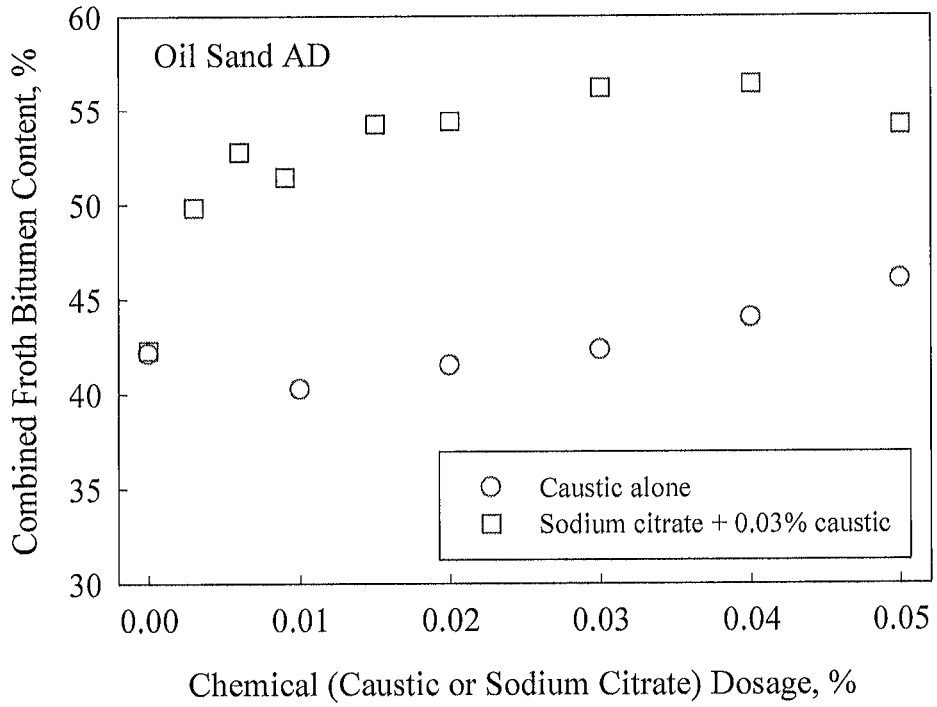
FIG. 10 is a graph showing combined froth bitumen content (%) as a function of dosage (wt %) of caustic alone or in combination with sodium citrate for poor oil sand AD.

FIG. 9 shows the results of the combined bitumen recovery. The results of the two test series were similar (about 90%) and did not appear to change with the chemical dosages. However, the combination of sodium citrate and caustic significantly improved the combined froth quality by increasing the combined froth bitumen content compared to caustic alone (FIG. 10).

The results of primary bitumen recovery and froth bitumen content were grouped by the total chemical dosage (Table 5). For every group at the same total chemical dosage, the combination of sodium citrate and caustic outperformed caustic alone.

TABLE 5

| Group | Chemical Dosage, wt % Total | Caustic | Sodium Citrate | Primary Bitumen Recovery, % | Primary Froth Bitumen Content, % |
|---|---|---|---|---|---|
| 1 | 0.040 | 0.04 | 0 | 78.9 | 48.7 |
| | 0.033 | 0.03 | 0.003 | 82.5 | 54.6 |
| | 0.036 | 0.03 | 0.006 | 81.0 | 58.4 |
| | 0.039 | 0.03 | 0.009 | 85.6 | 56.9 |
| 2 | 0.050 | 0.05 | 0 | 78.6 | 48.6 |
| | 0.045 | 0.03 | 0.015 | 84.9 | 58.9 |
| | 0.050 | 0.03 | 0.020 | 87.4 | 60.3 |

TABLE 4

| Group | Chemical Dosage, wt % Caustic | Sodium Citrate | Bitumen Recovery, % Primary | Secondary | Froth | Combined | Total | Froth Quality Bitumen Content, % Primary | Secondary | Combined | Solids Content, % Primary | Secondary | Combined |
|---|---|---|---|---|---|---|---|---|---|---|---|---|---|
| 1 | 0 | 0 | 70.2 | 15.9 | 1.6 | 86.1 | 87.7 | 50.3 | 24.4 | 42.1 | 8.2 | 19.2 | 11.6 |
| | 0.01 | 0 | 73.6 | 17.9 | 1.6 | 91.5 | 93.2 | 50.0 | 22.3 | 40.2 | 9.2 | 21.5 | 13.6 |
| | 0.02 | 0 | 70.5 | 18.0 | 1.9 | 88.5 | 90.4 | 48.2 | 26.7 | 41.5 | 9.3 | 17.7 | 11.9 |
| | 0.03 | 0 | 73.1 | 16.1 | 2.1 | 89.1 | 91.3 | 48.1 | 27.4 | 42.3 | 9.9 | 18.3 | 12.3 |
| | 0.04 | 0 | 78.9 | 11.9 | 1.8 | 90.8 | 92.7 | 48.7 | 26.7 | 44.0 | 10.6 | 18.0 | 12.2 |
| | 0.05 | 0 | 78.6 | 12.1 | 2.2 | 90.7 | 92.9 | 48.6 | 34.1 | 46.0 | 9.7 | 18.9 | 11.4 |
| 2 | 0.03 | 0.003 | 82.5 | 7.5 | 1.9 | 90.0 | 91.9 | 54.6 | 25.3 | 49.8 | 9.1 | 20.7 | 11.0 |
| | 0.03 | 0.006 | 81.0 | 9.2 | 2.1 | 90.2 | 92.3 | 58.4 | 28.6 | 52.8 | 9.2 | 20.5 | 11.3 |
| | 0.03 | 0.009 | 85.6 | 5.1 | 1.9 | 90.7 | 92.5 | 56.9 | 19.7 | 51.4 | 9.6 | 19.8 | 11.1 |
| | 0.03 | 0.015 | 84.9 | 6.1 | 1.8 | 91.0 | 92.8 | 58.9 | 25.8 | 54.2 | 9.4 | 24.5 | 11.5 |
| | 0.03 | 0.020 | 87.4 | 5.1 | 1.5 | 92.5 | 93.9 | 60.3 | 20.3 | 54.4 | 9.5 | 23.8 | 11.6 |
| | 0.03 | 0.030 | 82.4 | 8.7 | 1.6 | 91.1 | 92.7 | 59.5 | 36.7 | 56.2 | 10.4 | 21.7 | 12.1 |
| | 0.03 | 0.040 | 88.0 | 3.6 | 1.5 | 91.6 | 93.0 | 64.6 | 13.7 | 56.4 | 10.7 | 27.7 | 13.4 |
| | 0.03 | 0.050 | 84.9 | 6.4 | 1.8 | 91.2 | 93.0 | 60.5 | 22.6 | 54.2 | 10.3 | 26.2 | 12.9 |

Figure 6:
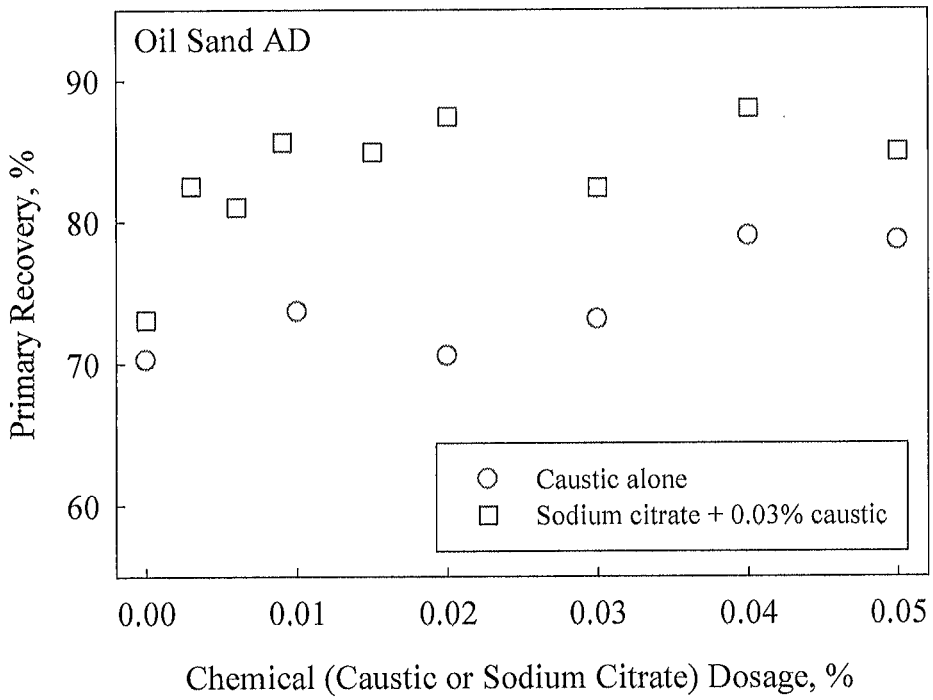
FIG. 6 is a graph showing primary bitumen recovery (%) as a function of dosage (wt %) using caustic alone or in combination with sodium citrate for poor oil sand AD.
Figure 7:
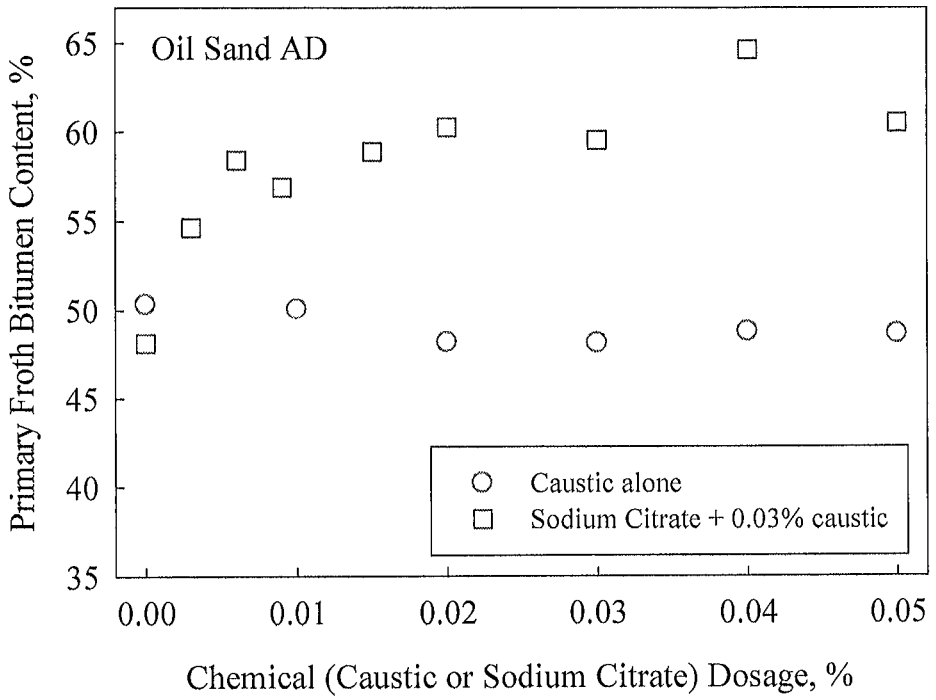
FIG. 7 is a graph showing primary froth bitumen content (%) as a function of dosage (wt %) using caustic alone or in combination with sodium citrate for poor oil sand AD.
Figure 8:
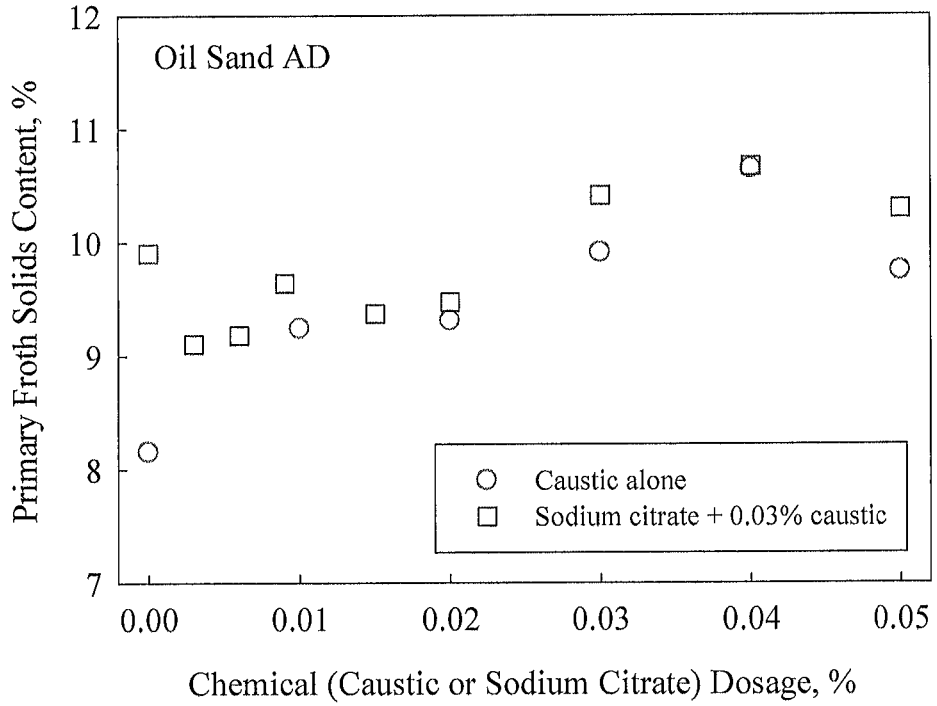
FIG. 8 is a graph showing primary froth solids content (%) as a function of dosage (wt %) using caustic alone or in combination with sodium citrate for poor oil sand AD.

For the combination of sodium citrate and caustic, the performance was generally better than caustic. Significant increases were observed for the primary bitumen recovery (FIG. 6) and primary froth quality (FIG. 7). The lowest primary bitumen recovery was 81% (sodium citrate, 0.006 wt %; caustic, 0.03 wt %) which was still higher than the highest primary bitumen recovery of 78.9% obtained with caustic (0.04 wt %). For caustic, the primary froth bitumen content was about 50% and did not generally change with increasing caustic dosage. In contrast, the primary froth bitumen content was higher than 60% with sodium citrate and caustic. The highest primary froth bitumen content was 64.6% with sodium citrate at 0.04 wt %. For the primary froth solids content, the results of the combination of sodium citrate and caustic were similar to those of caustic (FIG. 8).

Pore Ore AAX

Ore AAX was a very poor processing ore. The primary bitumen recovery was low at 13.0% coupled with a low primary froth bitumen content at 19.7% when no process aid was used (Table 6). Even at the highest caustic dosage (0.05 wt %), the primary recovery remained low at 26.7%, and did not appear to change with the increased caustic dosage from 0.02 wt % to 0.04 wt %. The dosage of 0.03 wt % was thus not necessarily the optimal dosage.

Figure 11:
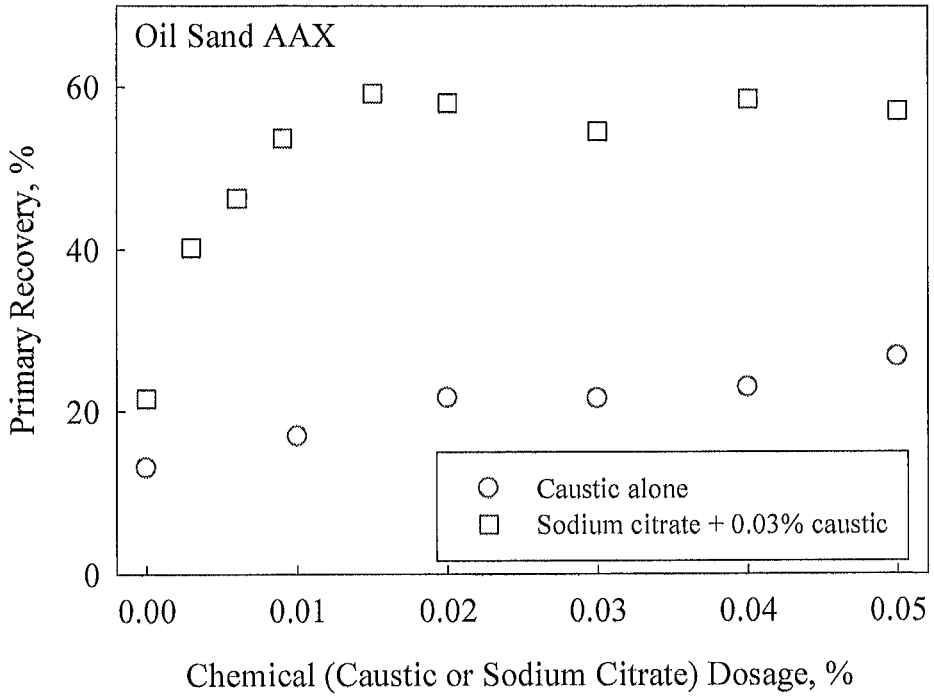
FIG. 11 is a graph showing primary bitumen recovery (%) as a function of dosage (wt %) using caustic alone or in combination with sodium citrate for poor oil sand AAX.
Figure 12:
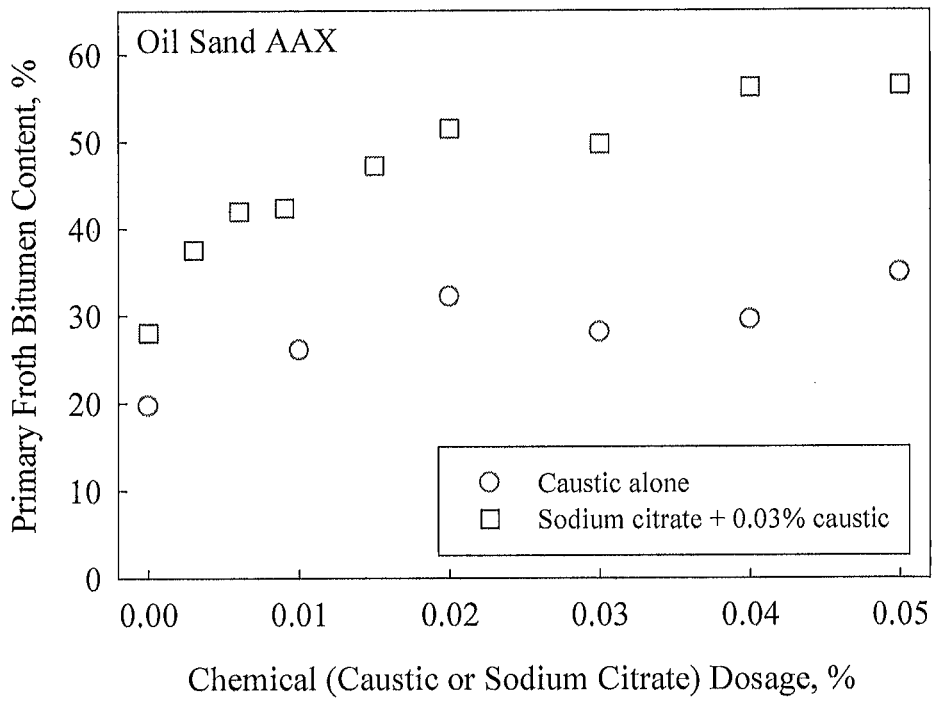
FIG. 12 is a graph showing primary froth bitumen content (%) as a function of dosage (wt %) using caustic alone or in combination with sodium citrate for poor oil sand AAX.
Figure 13:
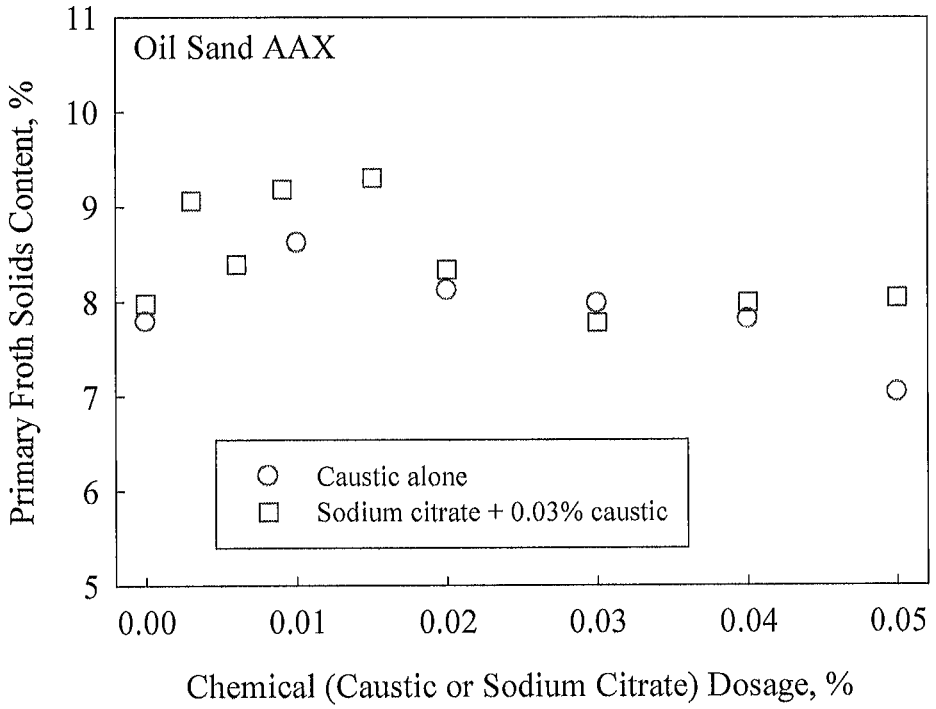
FIG. 13 is a graph showing primary froth solids content (%) as a function of dosage (wt %) using caustic alone or in combination with sodium citrate for poor oil sand AAX.

The combination of sodium citrate and caustic outperformed caustic alone, increasing the primary bitumen recovery (FIG. 11) and froth bitumen content (FIG. 12). The best performance for caustic was obtained at the highest dosage of 0.05 wt %. The combined use of sodium citrate and caustic yielded greater increases in the primary bitumen recovery (FIG. 11) and froth bitumen content (FIG. 12)

compared to caustic alone. The best performance was achieved with the combination of reagents (caustic at 0.03 wt % and sodium citrate dosage at 0.015 wt %) which yielded a primary bitumen recovery of 59.2% and a primary froth bitumen content of 47.2%. For the primary froth solids content, the results of the combination of sodium citrate and caustic were similar to those of caustic alone (FIG. 13).

Figure 14:
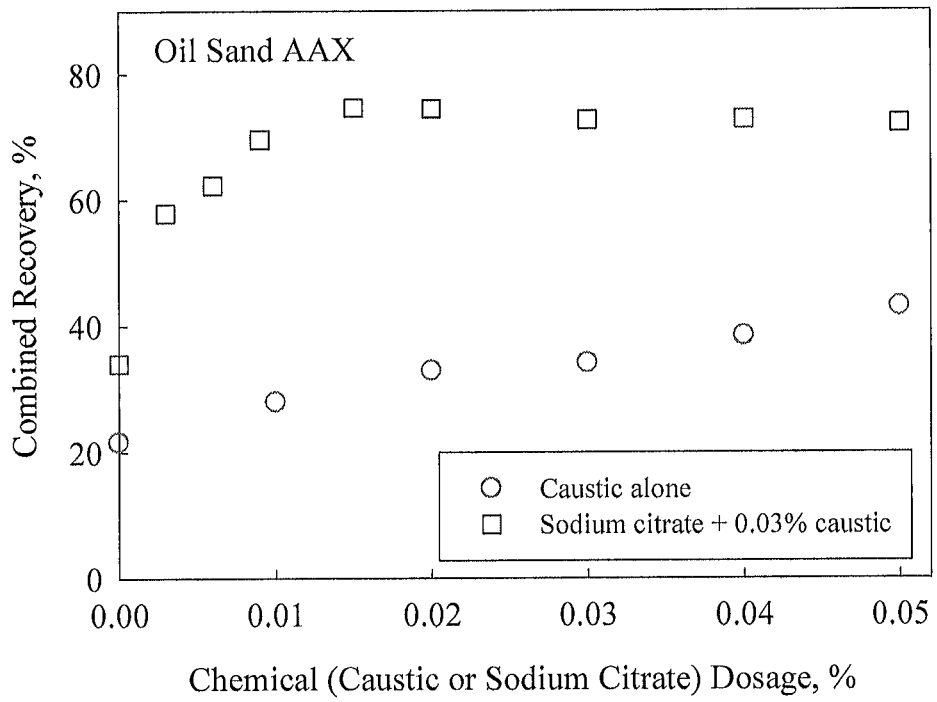
FIG. 14 is a graph showing combined bitumen recovery (%) as a function of dosage (wt %) using caustic alone or in combination with sodium citrate for poor oil sand AAX.
Figure 15:
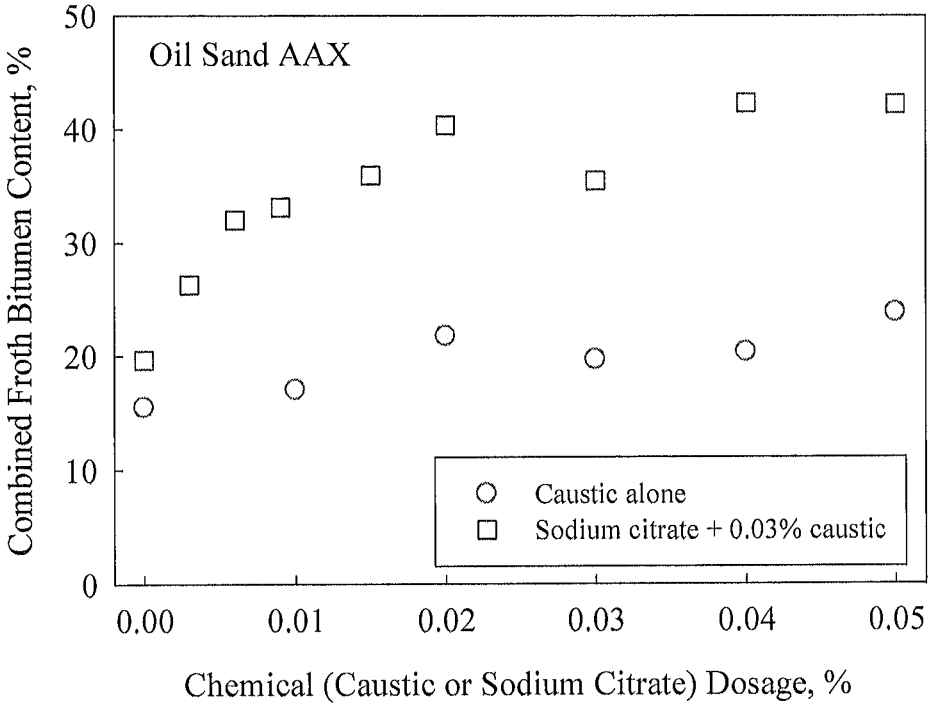
FIG. 15 is a graph showing combined froth bitumen content (%) as a function of dosage (wt %) of caustic alone or in combination with sodium citrate for poor oil sand AAX.

The combination of caustic and sodium citrate improved the combined bitumen recovery (FIG. 14) and froth bitumen content (FIG. 15) when compared to caustic alone.

TABLE 6

| | Chemical Dosage, wt % | | Bitumen Recovery, % | | | | | Froth Quality | | | | | |
|---|---|---|---|---|---|---|---|---|---|---|---|---|---|
| | | Sodium | Wall | | | | | Bitumen Content, % | | | Solids Content, % | | |
| Group | Caustic | Citrate | Primary | Secondary | Froth | Combined | Total | Primary | Secondary | Combined | Primary | Secondary | Combined |
| 1 | 0 | 0 | 13.0 | 8.6 | 0.6 | 21.6 | 22.2 | 19.7 | 11.6 | 15.5 | 7.8 | 16.2 | 12.2 |
| | 0.01 | 0 | 16.9 | 11.0 | 0.7 | 27.9 | 28.6 | 26.0 | 11.1 | 17.0 | 8.6 | 15.2 | 12.6 |
| | 0.02 | 0 | 21.6 | 11.2 | 0.7 | 32.8 | 33.5 | 32.1 | 13.3 | 21.7 | 8.1 | 15.3 | 12.1 |
| | 0.03 | 0 | 21.5 | 12.5 | 0.9 | 34.1 | 34.9 | 28.0 | 12.9 | 19.6 | 8.0 | 14.7 | 11.7 |
| | 0.04 | 0 | 22.9 | 15.4 | 1.0 | 38.3 | 39.3 | 29.4 | 13.9 | 20.3 | 7.8 | 14.9 | 12.0 |
| | 0.05 | 0 | 26.7 | 16.2 | 1.1 | 42.9 | 44.0 | 34.8 | 15.7 | 23.8 | 7.0 | 14.8 | 11.5 |
| 2 | 0.03 | 0.003 | 40.3 | 17.6 | 1.3 | 57.8 | 59.1 | 37.6 | 15.6 | 26.3 | 9.1 | 16.7 | 13.0 |
| | 0.03 | 0.006 | 46.3 | 15.9 | 1.3 | 62.2 | 63.5 | 42.0 | 19.0 | 32.0 | 8.4 | 19.6 | 13.2 |
| | 0.03 | 0.009 | 53.7 | 15.8 | 1.4 | 69.5 | 70.9 | 42.4 | 19.0 | 33.1 | 9.2 | 20.0 | 13.5 |
| | 0.03 | 0.015 | 59.2 | 15.4 | 1.4 | 74.6 | 75.9 | 47.2 | 18.7 | 35.9 | 9.3 | 19.0 | 13.2 |
| | 0.03 | 0.020 | 58.0 | 16.4 | 1.2 | 74.4 | 75.6 | 51.5 | 22.9 | 40.3 | 8.3 | 21.5 | 13.4 |
| | 0.03 | 0.030 | 54.5 | 18.0 | 1.1 | 72.6 | 73.7 | 49.7 | 19.0 | 35.5 | 7.8 | 19.0 | 13.0 |
| | 0.03 | 0.040 | 58.5 | 14.1 | 1.1 | 72.7 | 73.8 | 56.2 | 20.9 | 42.3 | 8.0 | 21.7 | 13.4 |
| | 0.03 | 0.050 | 57.1 | 14.9 | 1.0 | 72.0 | 73.0 | 56.4 | 21.5 | 42.2 | 8.0 | 21.0 | 13.3 |

The results of the primary bitumen recovery and the primary froth bitumen content for pore ore AAX were grouped by the total chemical dosage (Table 7). For every group at the same total chemical dosage, the combination of caustic (0.03 wt %) and sodium citrate at varying dosages (0.003-0.02 wt %) performed significantly better than caustic alone.

TABLE 7

| | Chemical Dosage, wt % | | | Primary Bitumen | Primary Froth Bitumen |
|---|---|---|---|---|---|
| Group | Total | Caustic | Sodium Citrate | Recovery, % | Content, % |
| 1 | 0.03 | 0.03 | 0 | 21.5 | 28.0 |
| | 0.033 | 0.03 | 0.003 | 40.3 | 37.6 |
| 2 | 0.04 | 0.04 | 0 | 22.9 | 29.4 |
| | 0.036 | 0.03 | 0.006 | 46.3 | 42.0 |
| | 0.039 | 0.03 | 0.009 | 53.7 | 42.4 |
| 3 | 0.05 | 0.05 | 0 | 26.7 | 34.8 |
| | 0.045 | 0.03 | 0.015 | 59.2 | 47.2 |
| | 0.05 | 0.03 | 0.020 | 58.0 | 51.5 |

Good Ore AR12

Testing of a good ore was conducted to confirm whether any of the process aids might have negative effects on the processability. Ore AR12 was a good processing ore, yielding a total recovery of 97.5% when no process aid was used (Table 8). Caustic alone (0.005-0.03 wt %), sodium citrate alone (0.003-0.03 wt %), and the combination of sodium citrate (0.003-0.03 wt %) and caustic (0.01 wt %) had little effect on the total bitumen recovery, but the combined use improved the primary bitumen recovery and froth quality.

TABLE 8

| | Chemical Dosage, wt % | | Bitumen Recovery, % | | | | | Froth Quality | | | | | |
|---|---|---|---|---|---|---|---|---|---|---|---|---|---|
| | | Sodium | Wall | | | | | Bitumen Content, % | | | Solids Content, % | | |
| Group | Caustic | Citrate | Primary | Secondary | Froth | Combined | Total | Primary | Secondary | Combined | Primary | Secondary | Combined |
| 1 | 0 | 0.000 | 88.0 | 7.7 | 1.7 | 95.8 | 97.5 | 52.9 | 29.6 | 49.8 | 12.3 | 22.2 | 13.6 |
| | 0.005 | 0.000 | 90.6 | 5.3 | 1.7 | 95.8 | 97.6 | 55.0 | 28.1 | 52.3 | 13.6 | 25.0 | 14.7 |
| | 0.01 | 0.000 | 92.5 | 3.4 | 2.1 | 95.9 | 98.0 | 55.7 | 28.3 | 53.9 | 12.8 | 24.7 | 13.6 |
| | 0.02 | 0.000 | 91.9 | 3.2 | 2.4 | 95.1 | 97.5 | 59.3 | 34.1 | 57.9 | 12.8 | 23.1 | 13.4 |
| | 0.03 | 0.000 | 92.2 | 3.3 | 2.2 | 95.5 | 97.8 | 61.7 | 31.5 | 59.7 | 13.1 | 18.8 | 13.4 |
| 2 | 0 | 0.003 | 89.1 | 6.2 | 2.3 | 95.2 | 97.5 | 56.6 | 28.8 | 53.2 | 13.4 | 21.5 | 14.3 |
| | 0 | 0.006 | 92.0 | 3.8 | 2.0 | 95.7 | 97.7 | 59.1 | 29.1 | 56.8 | 13.8 | 22.1 | 14.4 |
| | 0 | 0.009 | 92.1 | 3.4 | 2.0 | 95.5 | 97.5 | 54.7 | 25.2 | 52.5 | 13.7 | 26.8 | 14.7 |
| | 0 | 0.020 | 92.6 | 2.1 | 1.3 | 94.7 | 95.9 | 64.0 | 28.4 | 62.3 | 13.4 | 28.9 | 14.2 |
| | 0 | 0.030 | 93.8 | 2.2 | 1.3 | 95.9 | 97.2 | 62.9 | 24.3 | 60.7 | 13.1 | 31.0 | 14.1 |
| 3 | 0.01 | 0.003 | 93.3 | 2.5 | 2.0 | 95.8 | 97.8 | 60.1 | 29.1 | 58.4 | 14.0 | 24.9 | 14.5 |
| | 0.01 | 0.006 | 94.1 | 2.0 | 1.7 | 96.1 | 97.8 | 59.8 | 27.6 | 58.4 | 14.2 | 25.7 | 14.7 |
| | 0.01 | 0.009 | 93.7 | 1.9 | 2.1 | 95.6 | 97.8 | 61.4 | 28.9 | 60.1 | 13.7 | 23.3 | 14.1 |
| | 0.01 | 0.020 | 94.3 | 1.6 | 1.6 | 95.9 | 97.5 | 66.0 | 25.8 | 64.3 | 12.8 | 24.7 | 13.3 |
| | 0.01 | 0.030 | 93.3 | 2.3 | 1.5 | 95.6 | 97.1 | 70.3 | 27.4 | 67.7 | 13.1 | 25.5 | 13.9 |

Figure 16:
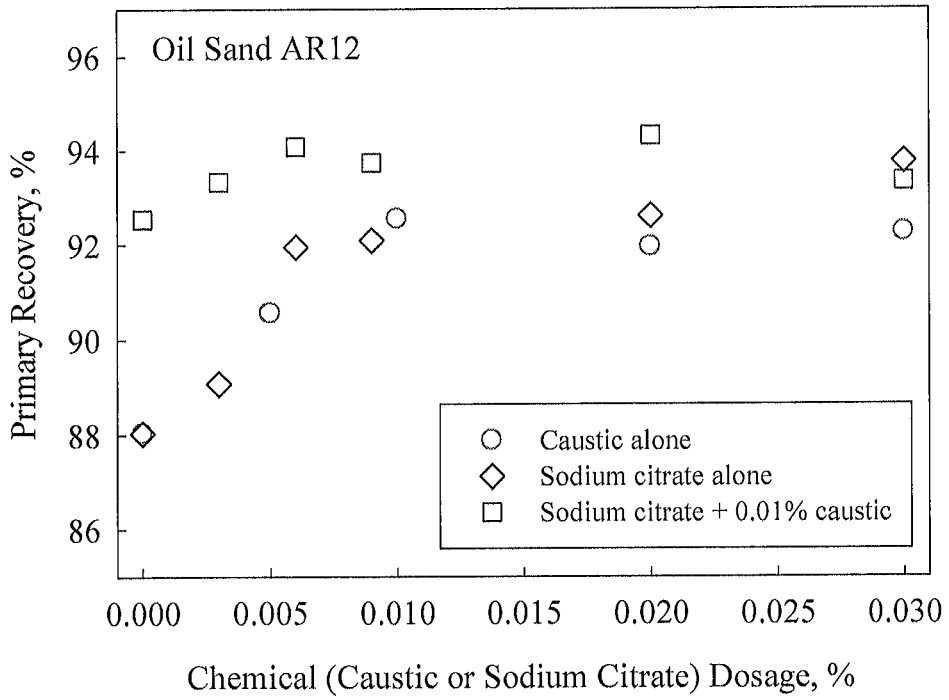
FIG. 16 is a graph showing primary bitumen recovery (%) as a function of dosage (wt %) using caustic or sodium citrate alone or in combination for good ore AR12.
Figure 17:
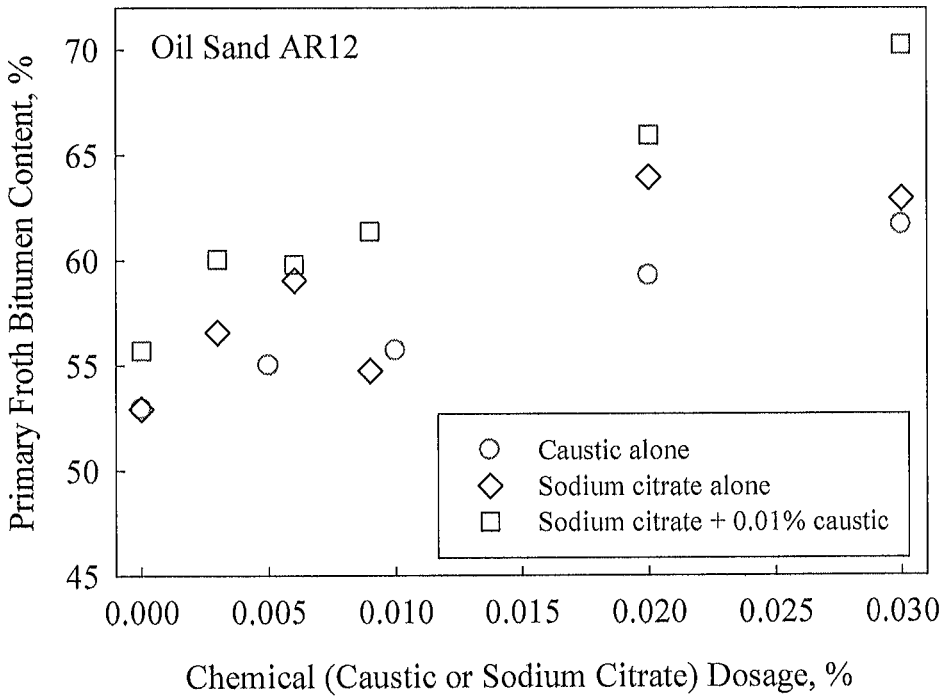
FIG. 17 is a graph showing primary froth bitumen content (%) as a function of dosage (wt %) using caustic or sodium citrate alone or in combination for good ore AR12.

The primary bitumen recovery was 88% when no process aid was used (FIG. 16). When caustic (0.01 wt %) was used, the primary bitumen recovery increased to 92.5% and did not appear to change as the dosage increased further. With sodium citrate (0.03 wt %), the primary bitumen recovery reached 93.8%. The combination of caustic (0.01 wt %) and sodium citrate (0.02 wt %) yielded a primary bitumen recovery of 94.3%. For the primary bitumen recovery and froth bitumen content, the results of sodium citrate alone were similar to those of caustic alone (FIGS. 16 and 17).

Figure 18:
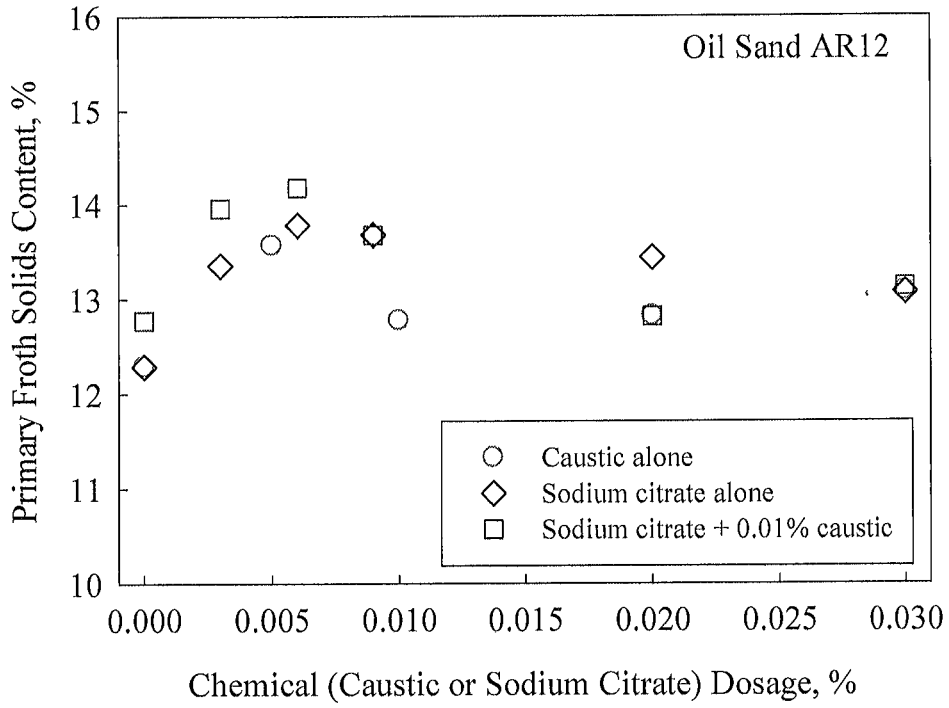
FIG. 18 is a graph showing primary froth solids content (%) as a function of dosage (wt %) using caustic or sodium citrate alone or in combination for good ore AR12.

Without the use of any process aid, the primary froth bitumen content was 52.9% (Table 8). The primary froth bitumen content increased with increasing caustic dosage, reaching 61.7% at the highest caustic dosage (0.03 wt %). With sodium citrate (0.02 wt %), the bitumen content was 64%. With caustic (0.01 wt %) and sodium citrate (0.03 wt %), the primary froth bitumen content reached 70.3%. For the primary froth solids content (FIG. 18), there were no noticeable differences among the various process aids.

Figure 19:
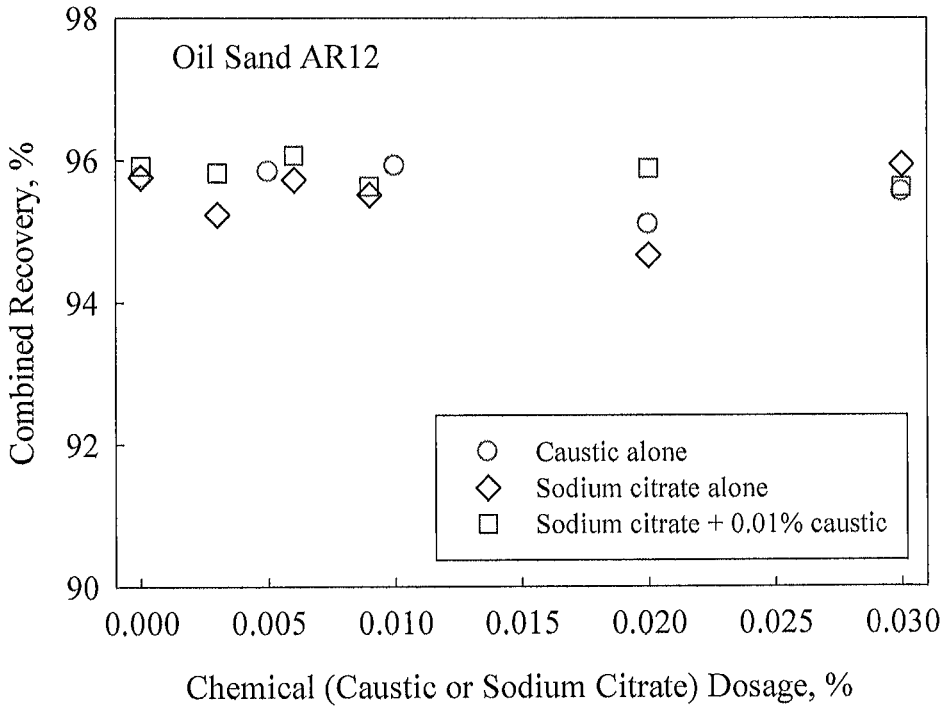
FIG. 19 is a graph showing combined bitumen recovery (%) as a function of dosage (wt %) using caustic or sodium citrate alone or in combination for good ore AR12.
Figure 20:
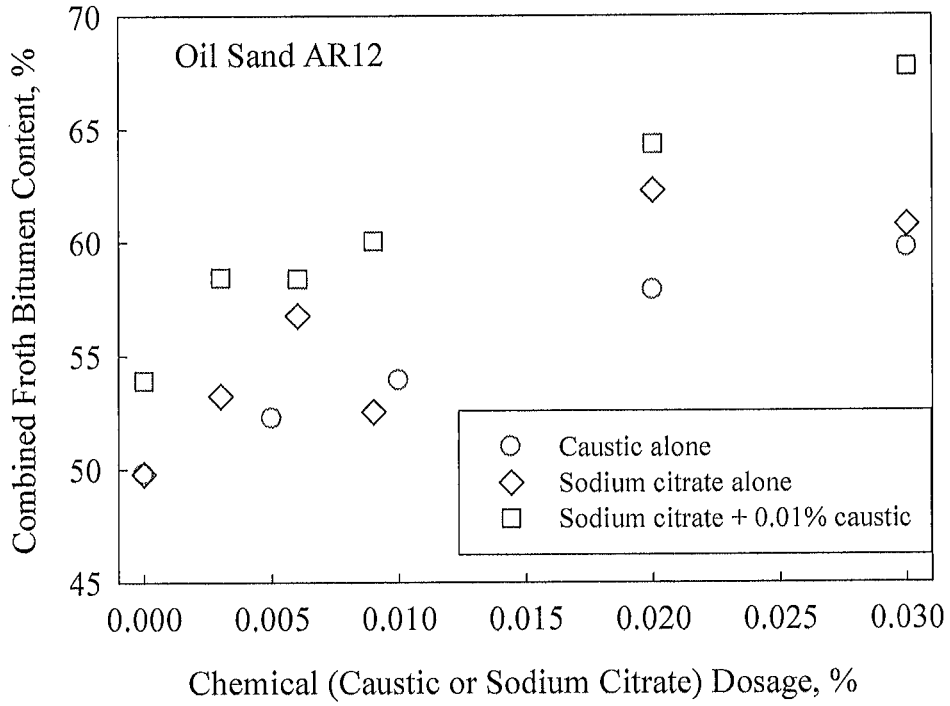
FIG. 20 is a graph showing combined froth bitumen content (%) as a function of dosage (wt %) using caustic or sodium citrate alone, or in combination, for good ore AR12.

The effects of sodium citrate alone and in combination with caustic on combined bitumen recovery are shown in FIG. 19. The results did not appear to change with increased dosage and were within the experimental error range. However, the combined froth bitumen quality was significantly improved by the combined use of caustic and sodium citrate (FIG. 20) as in the case for the primary froth bitumen content (FIG. 17). Overall, the results indicate that use of sodium citrate alone and in combination with caustic did not have any negative impacts on the processability of the good ore. In contrast, the combined use of caustic and sodium citrate improved primary bitumen recovery and primary bitumen froth quality.

The results of the primary bitumen recovery and the primary froth bitumen content were grouped by the total chemical dosage (Table 9). For every group at the same total chemical dosage, the combination of caustic and sodium citrate at varying dosages performed significantly better than caustic alone.

TABLE 9

| | Chemical Dosage, wt % | | | Primary | |
|---|---|---|---|---|---|
| Group | Total | Caustic | Sodium Citrate | Bitumen Recovery, % | Primary Froth Bitumen Content, % |
| 1 | 0.020 | 0.02 | 0.000 | 91.9 | 59.3 |
| | 0.013 | 0.01 | 0.003 | 93.3 | 60.1 |
| | 0.016 | 0.01 | 0.006 | 94.1 | 59.8 |
| | 0.019 | 0.01 | 0.009 | 93.7 | 61.4 |
| | 0.020 | 0 | 0.020 | 92.6 | 64.0 |
| 2 | 0.030 | 0.03 | 0.000 | 92.2 | 61.7 |
| | 0.030 | 0 | 0.030 | 93.8 | 62.9 |
| | 0.030 | 0.01 | 0.020 | 94.3 | 66.0 |

Synergistic Effect of Caustic and Sodium Citrate

The combined use of sodium citrate and caustic is preferred due to having a synergistic effect. For each of the poor ores (AD, AAX and AR) and good ore (AR12), the overall performance was improved with the combination of reagents which enhanced the primary bitumen recoveries and froth bitumen contents compared to use of caustic alone (Table 10). Even a relatively low dosage of sodium citrate (0.003 wt %) may improve both the primary bitumen recovery and froth bitumen content compared to caustic alone. The combined use of sodium citrate and caustic required a lower amount of total chemical addition than the use of caustic, and was more effective at much lower dosages than caustic. The combined use of sodium citrate and caustic minimizes the amount of caustic.

TABLE 10

| | Chemical Dosage, wt % | | | Primary | Primary Froth |
|---|---|---|---|---|---|
| Oil Sand | Total | Caustic | Sodium Citrate | Bitumen Recovery, % | Bitumen Content, % |
| AD | 0.030 | 0.03 | 0 | 73.1 | 48.1 |
| | 0.033 | 0.03 | 0.003 | 82.5 | 54.6 |
| | 0.040 | 0.04 | 0 | 78.9 | 48.7 |
| | 0.039 | 0.03 | 0.009 | 85.6 | 56.9 |
| | 0.05 | 0.05 | 0 | 78.6 | 48.6 |
| | 0.05 | 0.03 | 0.02 | 87.4 | 60.3 |
| AAX | 0.030 | 0.03 | 0 | 21.5 | 28.0 |
| | 0.033 | 0.03 | 0.003 | 40.3 | 37.6 |
| | 0.040 | 0.04 | 0 | 22.9 | 29.4 |
| | 0.039 | 0.03 | 0.009 | 53.7 | 42.4 |

TABLE 10-continued

| Oil Sand | Chemical Dosage, wt % Total | Caustic | Sodium Citrate | Primary Bitumen Recovery, % | Primary Froth Bitumen Content, % |
|---|---|---|---|---|---|
| | 0.05 | 0.05 | 0 | 26.7 | 34.8 |
| | 0.05 | 0.03 | 0.02 | 58.0 | 51.5 |
| AR | 0.02 | 0.02 | 0 | 15.5 | 25.9 |
| | 0.02 | 0.01 | 0.01 | 20.5 | 33.9 |
| | 0.030 | 0.03 | 0 | 21.1 | 28.8 |
| | 0.033 | 0.03 | 0.003 | 28.8 | 36.7 |
| | 0.040 | 0.04 | 0 | 17.9 | 29.4 |
| | 0.039 | 0.03 | 0.009 | 34.6 | 43.8 |
| AR12 | 0.020 | 0.02 | 0 | 91.9 | 59.3 |
| | 0.020 | 0 | 0.020 | 92.6 | 64.0 |
| | 0.019 | 0.01 | 0.009 | 93.7 | 61.4 |
| | 0.03 | 0.03 | 0 | 92.2 | 61.7 |
| | 0.03 | 0 | 0.03 | 93.8 | 62.9 |
| | 0.03 | 0.01 | 0.02 | 94.3 | 66.0 |

EXAMPLE 2

Figure 21:
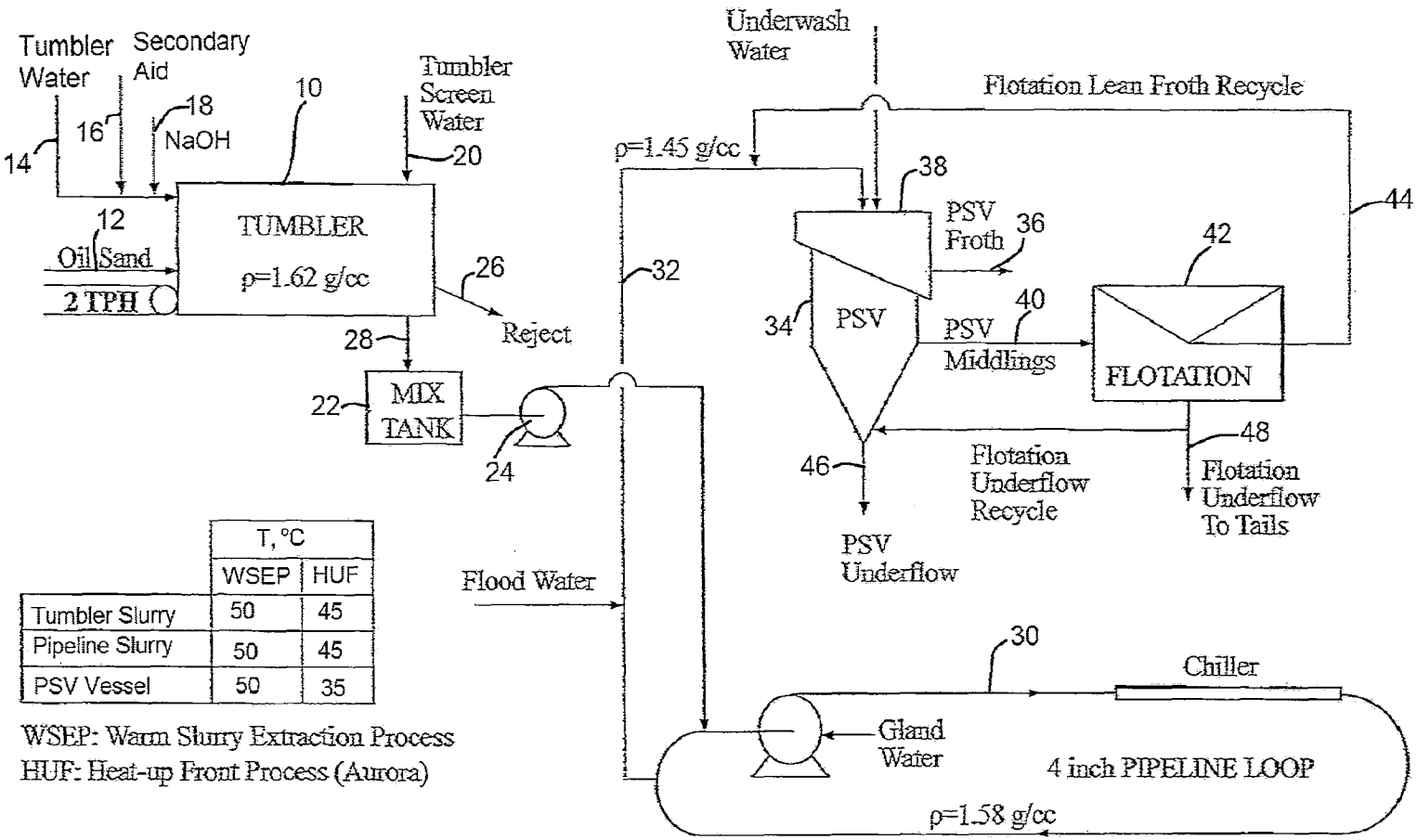
FIG. 21 is a flowsheet of a bitumen extraction pilot plant used to demonstrate the present invention.

FIG. 21 is a flowsheet of a bitumen extraction pilot plant used to demonstrate the present invention on a larger scale. The pilot plant comprises a tumbler 10 having a screen (not shown) for screening out rejects 26. The tumbler 10 is used to prepare the oil sand slurry. To the tumbler 10 is added oil sand ore, generally via a conveyor belt, which oil sand ore may be crushed oil sand ore. Water 14, generally warm or hot water, is also added to tumbler 10. In this set of experiments, a secondary aid consisting of sodium citrate or sodium hydroxide 18 or both sodium citrate and sodium hydroxide were added to the tumbler water 14 prior to entering tumble 10. Screened oil sand slurry 28 was first retained in a mix tank 22 prior to pumping the oil sand slurry via pump 24 through conditioning pipeline loop 30. The conditioned oil sand slurry 32 is then introduced into a separation zone, i.e., into a primary separation vessel (PSV) 34. The PSV 34 operates under quiescent conditions so that bitumen froth 36 floats to the top of the PSV 34 and is removed via launder 38. PSV middlings 40 can be removed for further treatment, for example, floatation in a floatation cell 42 to produce lean froth 44 which can be recycled back to the PSV 34. PSV tailings (underflow) 46 and floatation tailings (underflow) 48 are disposed and or further treated.

The flowsheet is operated under two conditions as follows:

| | T, ° C. WSEP | HUF |
|---|---|---|
| Tumbler Slurry | 50 | 45 |
| Pipeline Slurry | 50 | 45 |
| PSV Vessel | 50 | 35, |

where WSEP stands for warm slurry extraction process and HUF stands for heat upfront process.

Samples of two poor ores and one average ore were tested (Table 11). The two poor ores had bitumen contents of 9.8% and 9.0%, with fines contents of 40.3% and 42.7%, respectively. The average ore had a bitumen content of 10.1% and a fines content of 29.5%.

TABLE 11

| Oil Sand | AW-14-04-13 | AT-14-06-19* | AC-14-04-26 |
|---|---|---|---|
| Bitumen Content, % | 9.8 | 9.0 | 10.1 |
| Fines Content, % <44 μm | 40.3 | 42.7 | 29.5 |

*Oil sand AT was severely aged

Poor Ore AW-14-04-13

Figure 22:
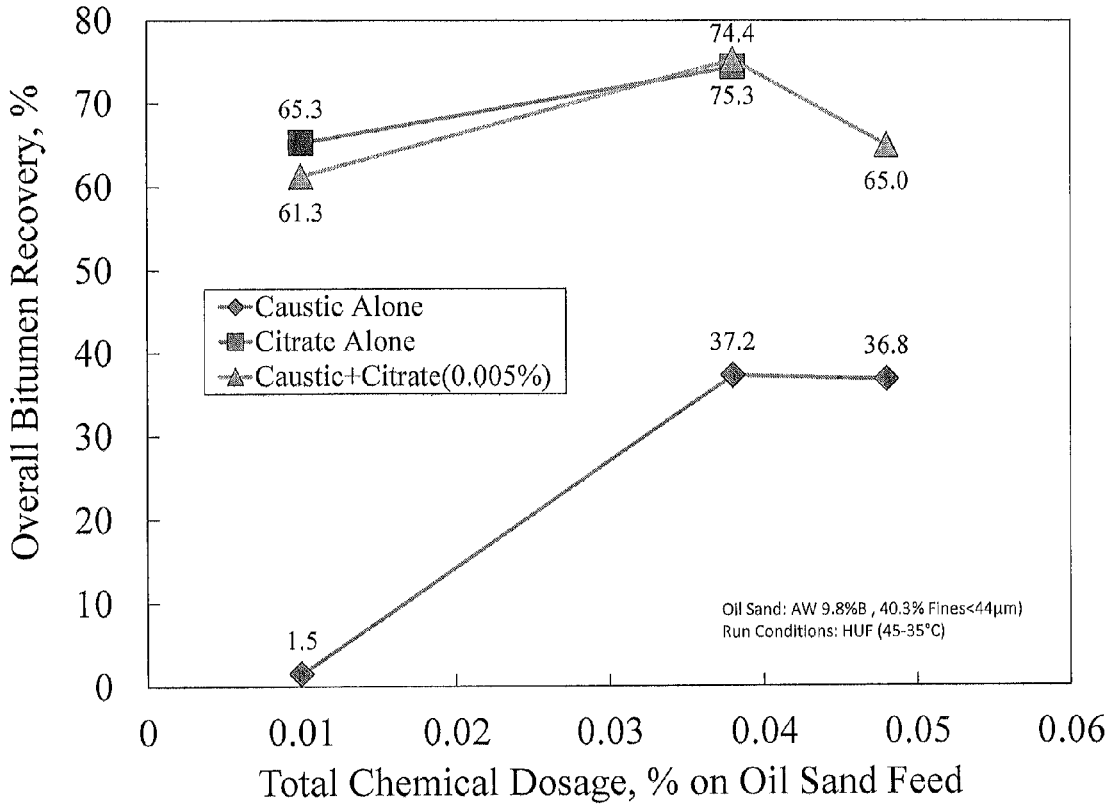
FIG. 22 is a graph showing overall bitumen recovery (%) as a function of dosage (wt %) using caustic or sodium citrate alone, or in combination, for poor ore AW-14-04-13 when a warm slurry extraction process (WSEP) is used in the pilot plant of FIG. 21.

Poor Ore AW-14-04-13 was processed using the flowsheet pilot plant under both the heat upfront process (HUF) and the warm slurry extraction process (WSEP). FIG. 22 shows the overall bitumen recovery (%) versus the total chemical dosage (% of oil sand feed), for caustic alone (diamonds), sodium citrate alone (squares) and a combination of caustic and sodium citrate (triangles) using HUF. In the combination, sodium citrate concentration remained constant (0.005 wt %) while the total chemical dosage varied, depending on the amount of caustic added. It can be seen in FIG. 22 that with this particular poor processing ore, when only low amounts of caustic (0.01 wt %) were added, the overall bitumen recovery was only 1.5%. Even at higher concentrations of caustic (0.05 wt %), the overall bitumen recovery was still fairly poor (36.8%). However, when sodium citrate alone was added, even at relatively small amounts (0.01 wt %), the overall bitumen recovery increased significantly (65.3%). Both 0.04 wt % sodium citrate and the combination of sodium citrate (0.005 wt %) and caustic (0.035) each produced the highest overall bitumen recovery of 74.4% and 75.3%, respectively.

Figure 23:
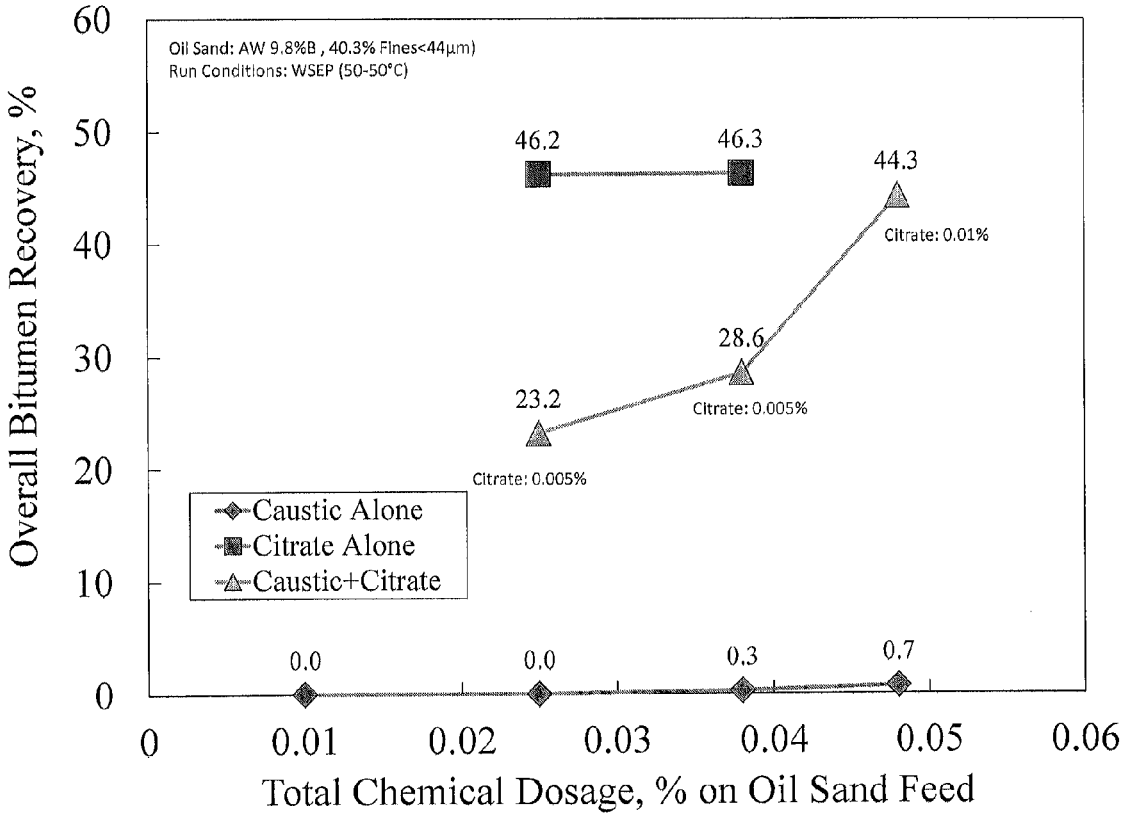
FIG. 23 is a graph showing overall bitumen recovery (%) as a function of dosage (wt %) using caustic or sodium citrate alone, or in combination, for poor ore AW-14-04-13 when a heat upfront process (HUF) is used in the pilot plant of FIG. 21.

FIG. 23 shows the results of this particular poor processing ore using WSEP. Even at the highest concentration of caustic (0.05 wt %), essentially no bitumen (0.7%) was recovered using WSEP, indicating that the oil sand was severely aged as compared to the results in FIG. 22. When the same dosage (0.05 wt %) of the combination of sodium citrate (0.01 wt %) and caustic (0.04 wt %) was used, overall bitumen recoveries dramatically increased to 44.3%.

Poor Ore AT-14-06-19

Figure 24:
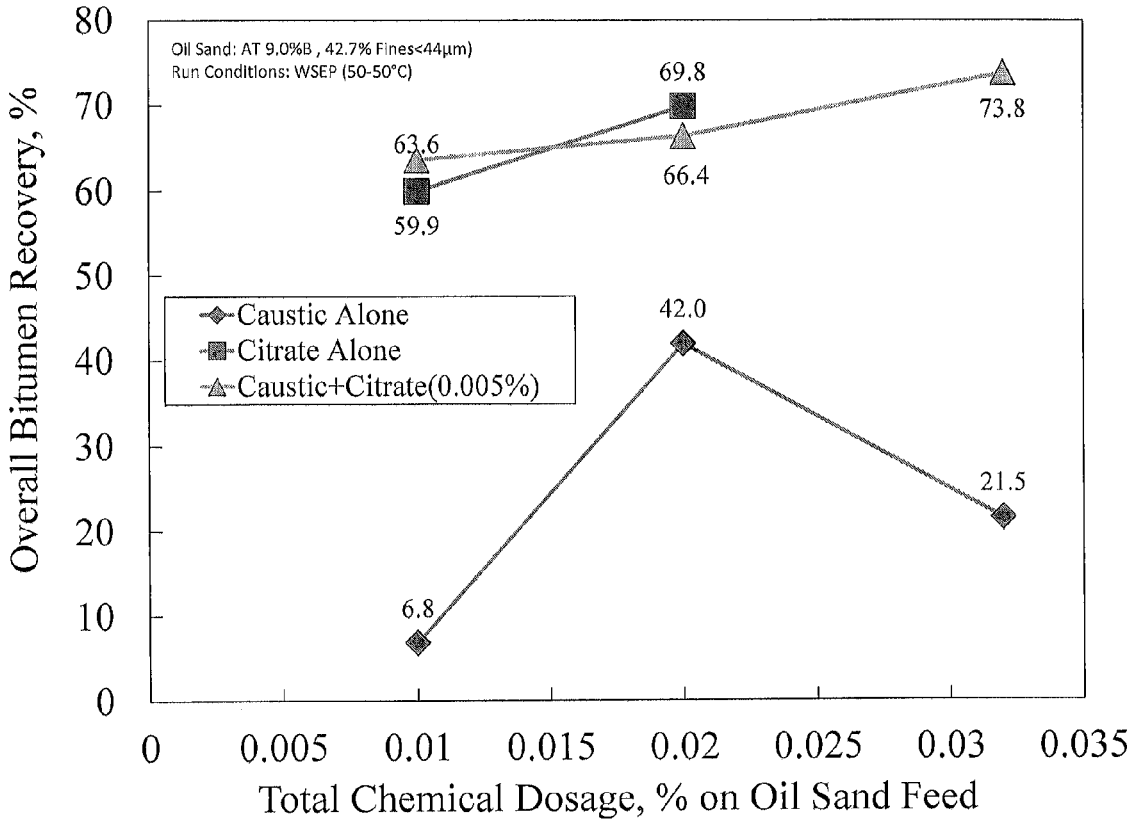
FIG. 24 is a graph showing overall bitumen recovery (%) as a function of dosage (wt %) using caustic or sodium citrate alone, or in combination, for poor ore AW-14-06-19 when a warm slurry extraction process (WSEP) is used in the pilot plant of FIG. 21.

Poor Ore AT-14-06-19 was processed using WSEP. As can be seen in FIG. 24, at low dosages of caustic, i.e., 0.01 wt %, the overall bitumen recovery was only 6.8. However, 0.01 wt % of citrate alone resulted in 59.9% overall bitumen recovery. The combination of 0.005 wt % sodium citrate and 0.005 wt % caustic (for a total dosage of 0.01 wt %) gave the best overall bitumen recovery (for a total chemical dosage of 0.01) at 63.6%. Addition of higher dosages of caustic alone initially increased bitumen recovery; however, bitumen recovery declined at a dosage of about 0.0325 wt %. However, when 0.0275 wt % caustic and 0.005 wt % citrate was used (giving the same total chemical dosage of about 0.0325 wt %), the overall bitumen recovery increased to 73.8%.

Average Ore AC-14-04-26

Figure 25:
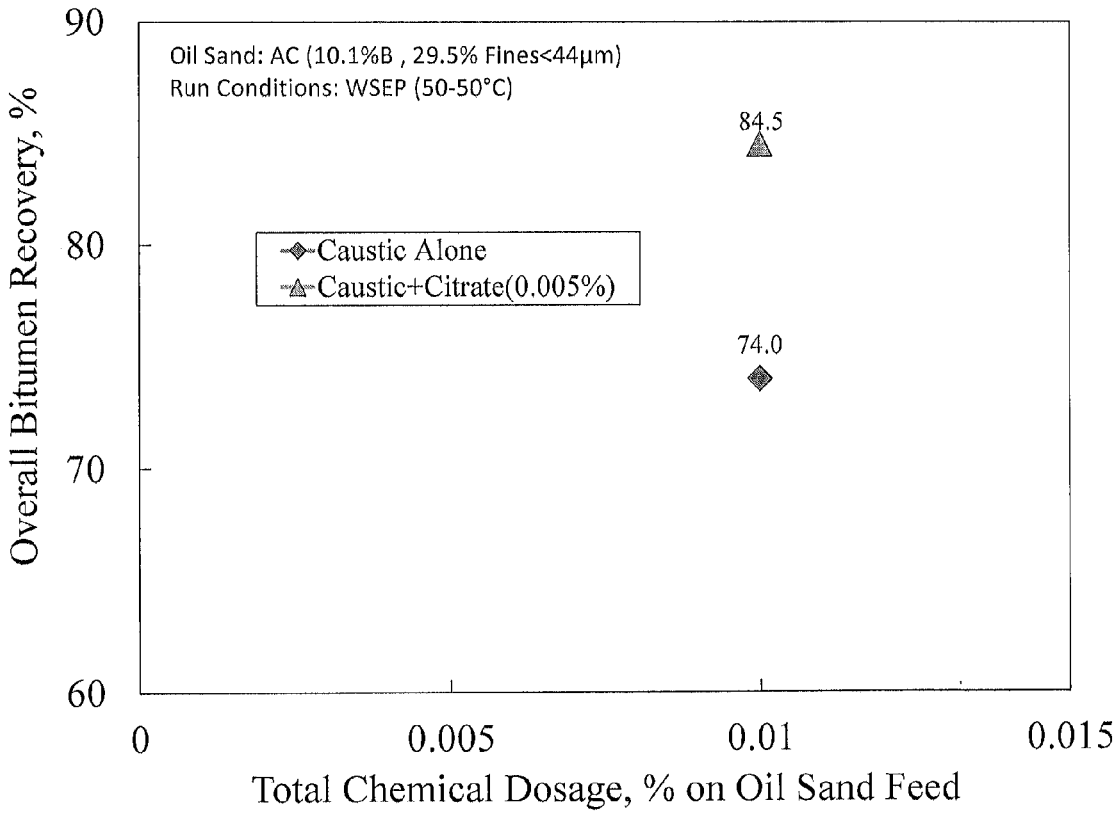
FIG. 25 is a graph showing overall bitumen recovery (%) as a function of dosage (wt %) using caustic or sodium citrate alone, or in combination, for average ore AC-14-04-26 when a warm slurry extraction process (WSEP) is used in the pilot plant of FIG. 21.

Average Ore AC-14-04-26 was processed using WSEP. As can be seen in FIG. 25, the same total chemical dosage of 0.01 wt % for caustic alone and caustic plus citrate, i.e., 0.005 wt % caustic+0.005 wt % sodium citrate, showed an additional 10.5% increase in overall bitumen recovery when the combination of caustic/sodium citrate was used.

What is claimed:

1. A process of extracting bitumen from oil sand ores, comprising:

determining a dosage (wt %) of caustic necessary to maximize the bitumen recovery for the oil sand ore to be processed when using caustic alone as a processing aid;

determining an amount of caustic (wt %) and an amount of sodium citrate (wt %) which yields substantially the same bitumen recovery or greater as the dosage (wt %) of caustic alone;

mixing the oil sand ore with heated water to produce an oil sand slurry; and adding the amounts of caustic (wt %) and sodium citrate (wt %) before, during or after mixing the oil sand ore with heated water to condition the oil sand slurry and to improve bitumen recovery from the oil sand ore;

wherein the sum of the amounts of caustic (wt %) and sodium citrate (wt %) is equal to or less than the dosage (wt %) of caustic alone.

2. The process of claim 1, wherein the bitumen content ranges from about 6% to about 10%, the fines content is greater than about 25%, the caustic amount ranges from about 0.01 wt % to about 0.05 wt %, and the sodium citrate amount ranges from about 0.003 wt % to about 0.05 wt %.

3. The process of claim 2, wherein the bitumen content is about 8%, the fines content is about 40%, the caustic amount is about 0.03 wt %, and the sodium citrate amount is about 0.015 wt %.

4. The process of claim 2, wherein the bitumen content is about 9%, the fines content is about 26%, the caustic amount is about 0.03 wt %, and the sodium citrate amount is about 0.05 wt %.

5. The process of claim 2, wherein the bitumen content is about 9.5%, the fines content is about 35%, the caustic amount is about 0.03 wt %, and the sodium citrate amount is about 0.04 wt %.

6. The process of claim 1, wherein the bitumen content is greater than about 10%, the fines content is less than about 20%, the caustic amount is about 0.01 wt %, and the sodium citrate amount ranges from about 0.003 wt % to about 0.03 wt %.

7. The process of claim 6, wherein the bitumen content is about 12%, the fines content is about 16%, the caustic amount is about 0.01 wt %, and the sodium citrate amount is about 0.02 wt %.

8. The process of claim 1, wherein a total dosage of caustic and sodium citrate is about 0.04 wt %, wherein the caustic amount ranges from about 0.01 wt % to about 0.03 wt %, and the sodium citrate amount ranges from about 0.01 wt % to about 0.03 wt %.

9. The process of claim 1, wherein the caustic comprises sodium hydroxide.

10. The process of claim 1, wherein the sodium citrate comprises trisodium citrate.

* * * * *